US009287629B2

(12) United States Patent
Kato et al.

(10) Patent No.: US 9,287,629 B2
(45) Date of Patent: Mar. 15, 2016

(54) IMPEDANCE CONVERSION DEVICE, ANTENNA DEVICE AND COMMUNICATION TERMINAL DEVICE

(71) Applicant: Murata Manufacturing Co., Ltd., Nagaokakyo-shi, Kyoto-fu (JP)

(72) Inventors: Noboru Kato, Nagaokakyo (JP); Kenichi Ishizuka, Nagaokakyo (JP); Noriyuki Ueki, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 377 days.

(21) Appl. No.: 13/834,487

(22) Filed: Mar. 15, 2013

(65) Prior Publication Data

US 2014/0266964 A1 Sep. 18, 2014

(51) Int. Cl.

| | |
|---|---|
| ***H01Q 9/30*** | (2006.01) |
| ***H01Q 1/50*** | (2006.01) |
| ***H01Q 5/335*** | (2015.01) |

(52) U.S. Cl.
CPC . *H01Q 9/30* (2013.01); *H01Q 1/50* (2013.01); *H01Q 5/335* (2015.01)

(58) Field of Classification Search
CPC ..... H01Q 1/50; H01Q 5/335; H01Q 9/30
USPC ..... 343/860
See application file for complete search history.

(56) References Cited

U.S. PATENT DOCUMENTS

| | | | | |
|---|---|---|---|---|
| 7,088,307 | B2 * | 8/2006 | Imaizumi | 343/860 |
| 2004/0217915 | A1 | 11/2004 | Imaizumi | |

FOREIGN PATENT DOCUMENTS

| | | | |
|---|---|---|---|
| JP | 2000-124728 | A | 4/2000 |
| JP | 2004-336250 | A | 11/2004 |
| JP | 2006-173697 | A | 6/2006 |
| JP | 2008-35065 | A | 2/2008 |

* cited by examiner

*Primary Examiner* — Hoang V Nguyen
(74) *Attorney, Agent, or Firm* — Keating & Bennett, LLP

(57) ABSTRACT

In a case in which a capacitor is not provided in parallel with a second inductance element, the impedance ratio between a first inductance element and the second inductance element is constant regardless of the frequency, but when a capacitor is provided, the parallel impedance of the capacitor and the second inductance element gradually increases at frequencies equal to and below the resonant frequency. Consequently, at frequencies equal to or below the resonant frequency, the higher the frequency becomes, the larger the value of the real portion of the impedance observed on a high-frequency-circuit side becomes. Therefore, by appropriately setting the values of the first inductance element, the second inductance element, and the capacitor, the frequency characteristics of the real portion of the impedance observed on the high-frequency-circuit side can be set to be similar to the frequency characteristics of the radiation resistance of the antenna.

17 Claims, 19 Drawing Sheets

IMPEDANCE CONVERSION DEVICE, ANTENNA DEVICE AND COMMUNICATION TERMINAL DEVICE

BACKGROUND OF THE INVENTION

1. Field of the Invention

The present invention relates to an impedance conversion device that is to be provided in an antenna device, an antenna device provided with the impedance conversion device, and a communication terminal device that includes the antenna device. More specifically, the present invention relates to a technology that provides an antenna device that performs matching over a wide frequency band.

2. Description of the Related Art

In recent years, there has been a demand for communication terminal devices, such as cellular phones, to be compatible with communication systems, such as global system for mobile communication (GSM) (registered trademark), digital communication system (DCS), personal communication services (PCS), and universal mobile telecommunications system (UMTS), and in addition, to be compatible with, for example, global positioning system (GPS), wireless LANs and Bluetooth (registered trademark). Therefore, there has been a demand for the antenna device of such a communication terminal device to cover a wide frequency band from around 700 MHz to around 2.7 GHz.

Antenna devices that cover a wide frequency band are generally equipped with a wide-band matching circuit including an LC parallel resonant circuit and an LC series resonant circuit as disclosed in, for example, Japanese Unexamined Patent Application Publication No. 2004-336250 and Japanese Unexamined Patent Application Publication No. 2006-173697. In addition, tunable antennas, such as those disclosed in Japanese Unexamined Patent Application Publication No. 2000-124728 and Japanese Unexamined Patent Application Publication No. 2008-035065, are also known examples of antenna devices that cover a wide frequency band.

However, since the matching circuits disclosed in Japanese Unexamined Patent Application Publication No. 2004-336250 and Japanese Unexamined Patent Application Publication No. 2006-173697 include a plurality of resonant circuits, the insertion loss of the matching circuit is likely to be large and a sufficient gain will not obtained.

On the other hand, the tunable antennas disclosed in Japanese Unexamined Patent Application Publication No. 2000-124728 and Japanese Unexamined Patent Application Publication No. 2008-035065 require a circuit for controlling a variable capacitance element, that is, a switching circuit for switching between frequency bands and, therefore, the circuit configuration is complicated. In addition, since the loss and strain are large in a switching circuit, it is possible that sufficient gain will not be obtained.

SUMMARY OF THE INVENTION

To overcome the problems described above, preferred embodiments of the present invention provide an impedance conversion device that performs matching between a feeder circuit and an antenna element over a wide frequency band, an antenna device including the impedance conversion device, and a communication terminal device including the antenna device.

According to a preferred embodiment of the present invention, an impedance conversion device, which is to be inserted between an antenna element and a feeder circuit, includes a first circuit including a first inductance element connected to the feeder circuit and a second circuit including a second inductance element connected to the antenna element and coupled with the first inductance element, the second circuit including a capacitor connected to the second inductance element.

According to another preferred embodiment of the present invention, an antenna device includes an antenna element and an impedance conversion circuit that is inserted between the antenna element and a feeder circuit, the impedance conversion circuit including a first circuit including a first inductance element connected to the feeder circuit and a second circuit including a second inductance element connected to the antenna element and coupled with the first inductance element, the second circuit including a capacitor connected to the second inductance element.

According to yet another preferred embodiment of the present invention, a communication terminal device includes an antenna device including an antenna element, a feeder circuit and an impedance conversion circuit connected between the antenna element and the feeder circuit, the impedance conversion circuit including a first circuit including a first inductance element connected to the feeder circuit and a second circuit including a second inductance element connected to the antenna element and coupled with the first inductance element, the second circuit including a capacitor that is connected to the second inductance element.

With various preferred embodiments of the present invention, with the use of an impedance conversion circuit, a real portion of an impedance having frequency characteristics with the same or substantially the same tendency as those of the radiation resistance of an antenna is obtained and a change in the frequency characteristics of the impedance of an antenna device is significantly reduced. Consequently, an antenna device in which matching to a high-frequency circuit is obtained over a wide frequency band is effectively achieved.

In addition, a communication terminal device can be provided that includes an antenna for which the change in frequency characteristics of impedance is small and that can be used with a variety of communication systems having different frequency bands.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1A:
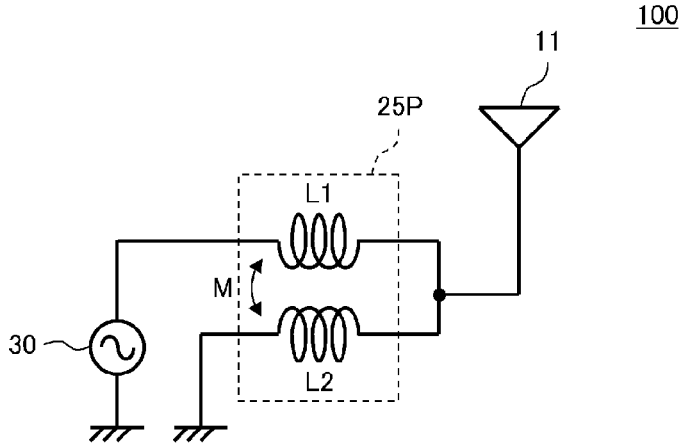
FIG. 1A is a circuit diagram of an antenna device according to a first preferred embodiment of the present invention.
Figure 1B:
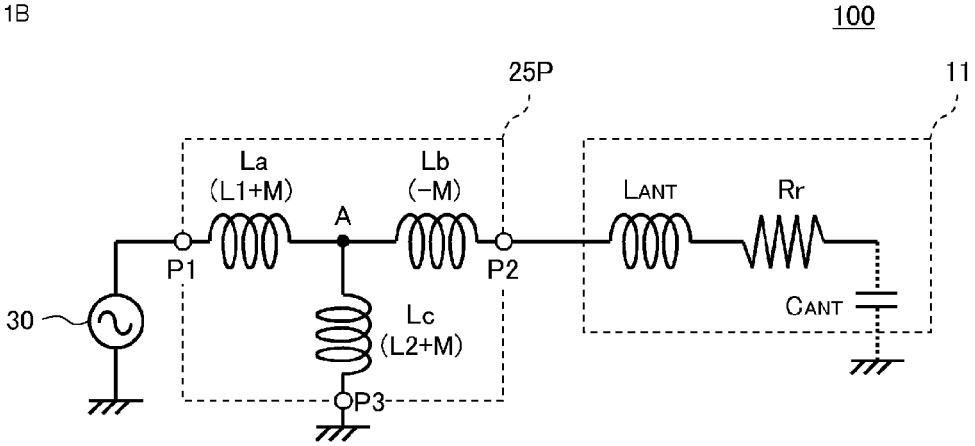
FIG. 1B is an equivalent circuit diagram therefor.

FIG. 1A is a circuit diagram of an antenna device 100 according to a first preferred embodiment of the present invention, and FIG. 1B is an equivalent circuit diagram therefor.

As illustrated in FIG. 1A, the antenna device 100 includes an antenna element 11 and an impedance conversion device 25P that is connected to the antenna element 11. The antenna element 11 is a monopole antenna and the impedance conversion device 25P is connected to a feeder terminal of the antenna element 11. The impedance conversion device 25P, and more particularly, a first inductance element L1 of the impedance conversion device 25, is inserted between the antenna element 11 and a feeder circuit 30. The feeder circuit 30 is a circuit that feeds a high-frequency signal to the antenna element 11 and generates and performs processing on a high-frequency signal, but may also include a circuit that combines and separates high-frequency signals.

The impedance conversion device 25P includes a first inductance element L1 that is connected to the feeder circuit 30 and a second inductance element L2 that is coupled with the first inductance element L1. More specifically, a first end of the first inductance element L1 is connected to the feeder circuit 30 and a second end of the first inductance element L1 is connected to the antenna element 11, and a first end of the second inductance element L2 is connected to the antenna element 11 and a second end of the second inductance element L2 is connected to ground.

The impedance conversion device 25P includes a transformer circuit in which the first inductance element L1 and the second inductance element L2 are closely coupled with each other via a mutual inductance M. A transformer circuit, as illustrated in FIG. 1B, can be equivalently converted into a T-type circuit preferably including three inductance elements La, Lb and Lc. That is, this T-type circuit preferably includes the first inductance element La connected between a first port P1, which is connected to the feeder circuit, and a branch point A, which is located between a second port P2, which is connected to the antenna element 11, a third port P3, which is connected to ground, and the first port P1; the second inductance element Lb connected between the second port P2 and the branch point A; and the third inductance element Lc connected between the third port P3 and the branch point A.

As illustrated in FIG. 1B, the antenna element 11 equivalently includes an inductance component LANT, a radiation resistance component Rr, and a capacitance component CANT.

The first inductance element L1 and the second inductance element L2 are coupled with each other, whereby a mutual inductance M is generated. A function achieved by the first inductance element L1 and the second inductance element L2 performs impedance conversion such that, a real portion of the impedance on the feeder circuit side (high-frequency circuit side) substantially matches the real portion of the impedance on the antenna side. Often, the impedance on the feeder circuit side is preferably set to about 50Ω and the impedance of the antenna element is preferably set to be lower than about 50Ω, for example.

If the real portion of the impedance observed on the feeder circuit 30 side from the point P2 in FIG. 1B is denoted by Rc, then Rc=impedance on feeder circuit side (50Ω)×L2/(L1+L2+2M). In order to match the real portions of the impedances of the antenna and the high-frequency circuit, the values of L1, L2 and M are set so that Rc=Rr. However, as has been described above, the real portion Rr of the impedance of the antenna also has frequency characteristics and in order for matching to be performed over a wide frequency band, it is necessary for Rc to have similar frequency characteristics to the real portion of Rr. The real portion of the impedance of the antenna generally corresponds to the sum of radiation loss and resistance loss, but in cases in which the resistance loss is small, the real portion of the impedance of the antenna substantially corresponds to the radiation resistance.

Figure 2A:
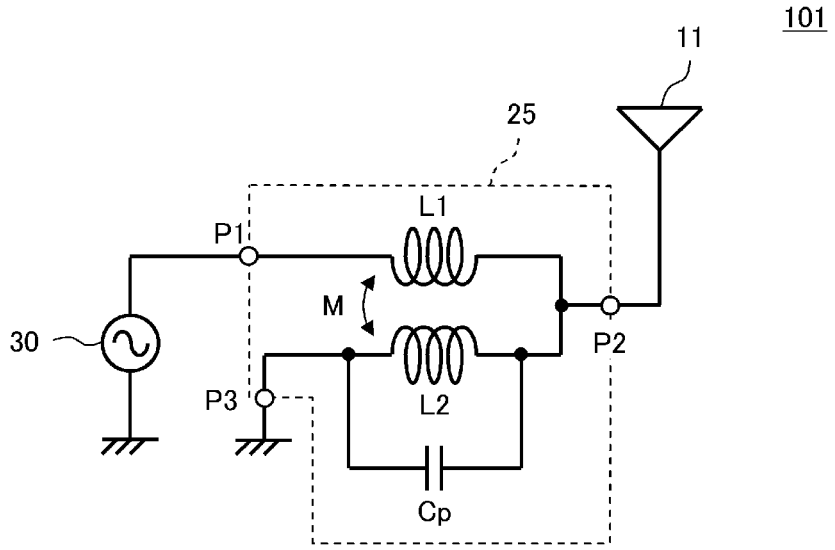
FIG. 2A is a circuit diagram of an antenna device in which the real portion of the impedance of a high-frequency circuit has frequency characteristics similar to those of the radiation resistance of an antenna.
Figure 2B:
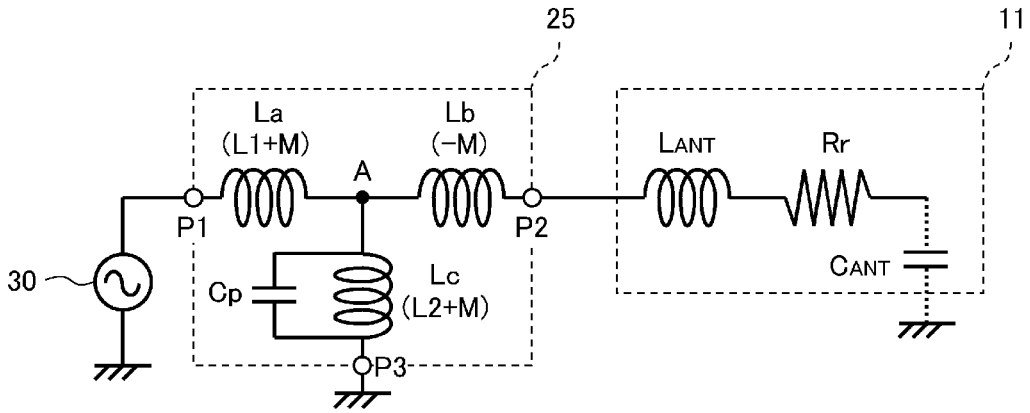
FIG. 2B is an equivalent circuit diagram for the antenna device illustrated in FIG. 2A.

FIG. 2A is a circuit diagram of an antenna device 101 in which a real portion Rc of the impedance of the high-frequency circuit has been configured to have frequency characteristics similar to those of the radiation resistance Rr of the antenna. FIG. 2B is an equivalent circuit diagram of the antenna device illustrated in FIG. 2A. As illustrated in FIG. 2A, a capacitor (capacitance) Cp is provided in parallel with the second inductance element L2, whereby, as illustrated in FIG. 2B, a structure in which a capacitor Cp has been added to the third inductance element Lc is obtained. As a result, the real portion Rc of the impedance observed on the feeder circuit (high-frequency circuit) side from the point P2 in FIGS. 2A and 2B can preferably be set to have frequency characteristics having the same or substantially the same tendency as those of the radiation resistance Rr of the antenna. That is, in the case in which the capacitor Cp is not provided, the impedance ratio between the first inductance element L1 and the second inductance element L2 is constant regardless of the frequency, but the parallel impedance of the capacitor Cp and the second inductance element L2 gradually increases as frequency increases at frequencies equal to or less than the resonant frequency. Consequently, at frequencies equal to or less than the resonant frequency, the higher the frequency becomes, the larger the value of Rc becomes. Therefore, by appropriately setting the element values of L1, L2 and Cp, the frequency characteristics of the real portion Rc of the impedance observed on the feeder circuit side from the point P2 can be set to be similar to the frequency characteristics of the radiation resistance Rr of the antenna. The capacitor Cp may preferably be provided by connecting a capacitor component in parallel with the second inductance element L2 or may preferably be a parasitic capacitance generated by a wiring line of the second inductance element L2 being arranged close to the ground conductor.

It has been described above that the impedance conversion device 25 causes the impedance of a high-frequency circuit to match the radiation resistance Rr of an antenna over a wide frequency band. In the first preferred embodiment of the present invention, as will be described next, matching is also preferably performed for a reactance component over a wide frequency band.

The first inductance element L1 and the second inductance element L2 illustrated in FIG. 2A (similar to FIG. 1A) are closely coupled with each other. As a result, an equivalent negative inductance component (−M) is generated. Then, due to this negative inductance component (−M), the inductance component of the antenna element 11 is canceled out such that the inductance component of the antenna element 11 is reduced. That is, since the effective inductive reactance component of the antenna element 11 is reduced, the antenna element 11 is not strongly dependent on the frequency of a high-frequency signal.

In FIG. 2A, if the inductance of the first inductance element L1 is denoted as L1, the inductance of the second inductance element L2 as L2 and the mutual inductance as M, in FIG. 2B, the inductance of the first inductance element La is L1+M, the inductance of the second inductance element Lb is −M and the inductance of the third inductance element Lc is L2+M. That is, the inductance of the second inductance element Lb has a negative value regardless of the values of L1 and L2. Thus, an equivalent negative inductance component is provided.

The inductance component LANT of the antenna element 11 is canceled out by the negative inductance component (−M) in the impedance conversion device 25. That is, the inductance component (of the antenna element 11 including the second inductance element Lb) observed on the antenna element 11 side from point A in the impedance conversion device 25 is reduced, (ideally to zero) and, as a result, the impedance frequency characteristics of the antenna device 101 are reduced.

In order to generate such a negative inductance component, it is important that the first inductance element L1 and the second inductance element L2 be coupled with each other with a high degree of coupling. Specifically, it depends on the element values of the inductance elements, but the degree of coupling is preferably about 0.1 or higher, and more preferably about 0.5 or higher, for example. The inductance component LANT of the antenna element 11 itself is not necessarily completely canceled out by the negative inductance component (−M) in the impedance conversion device 25, but as long as the inductance component LANT of the antenna element 11 itself can be reduced by the negative inductance component (−M) in the impedance conversion device 25, an improved matching for the reactance component is obtained.

Thus, both real and imaginary portions of impedances of the antenna and a high-frequency circuit can be matched over a wide frequency band.

Figure 3:
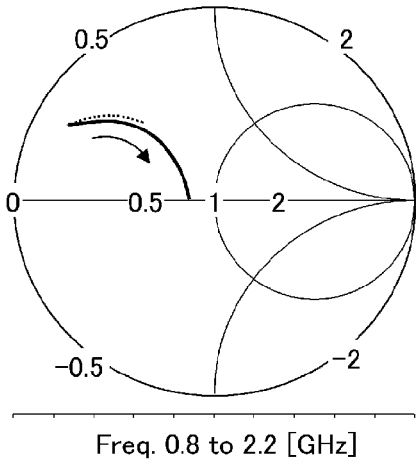
FIG. 3 illustrates an example of a simulation of input impedance observed on a high-frequency circuit side from point P2 in FIGS. 2A and 2B.
Figure 4:
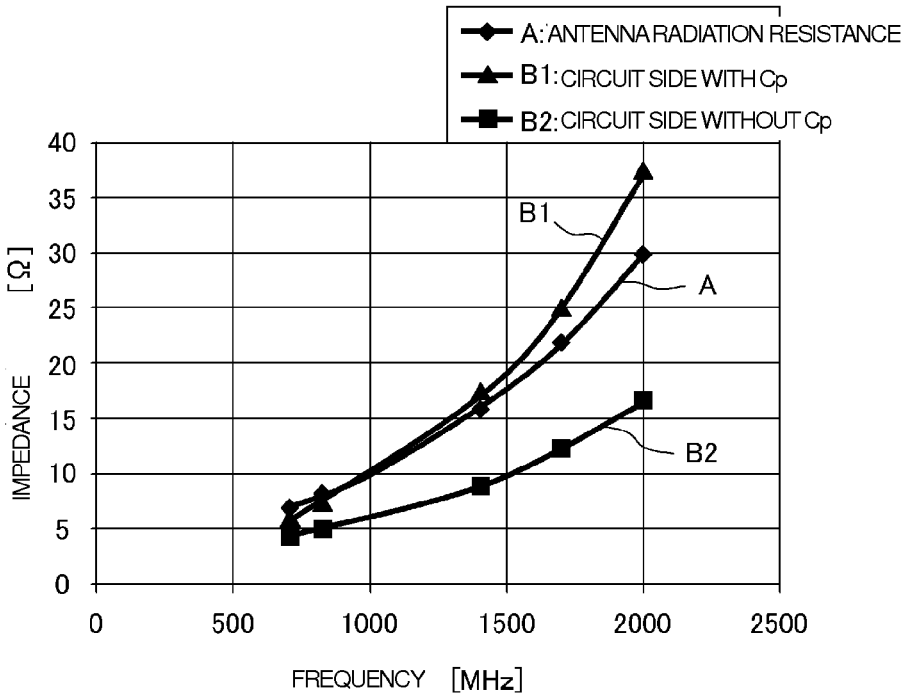
FIG. 4 illustrates the frequency characteristics of the real portion of the impedance (resistance component of an impedance conversion device observed from point P2 in FIGS. 2A and 2B.

FIG. 3 illustrates an example of a simulation of input impedance observed on the high-frequency circuit side from the point P2. A dotted line represents the characteristics in a case in which there is no capacitor Cp. A solid line represents the characteristics in a case in which the capacitor Cp is provided. It is clear that the frequency characteristics of the impedance are changed such that the value of the radiation resistance Rr on the high-frequency side is larger as a result of the capacitor Cp being provided. FIG. 4 illustrates the frequency characteristics of the real portion of an impedance (resistance component) of the impedance conversion device 25 observed from the point P2. In FIG. 4, A denotes the radiation resistance of the antenna, B1 denotes the real portion of the impedance of the impedance conversion device observed on the high-frequency circuit side from the point P2 in the case in which the capacitor Cp is provided, and B2 denotes the real portion of the impedance of the impedance conversion device observed on the high-frequency circuit side from the point P2 in the case in which the capacitor Cp is not provided. It is clear that, in the case in which the capacitor Cp is provided, the frequency characteristics of the real portion Rc of the impedance observed on the high-frequency circuit side from the point P2 is similar to the frequency characteristics of the radiation resistance Rr of the antenna, and can be matched with the high-frequency circuit over a wide frequency band.

Figure 5:
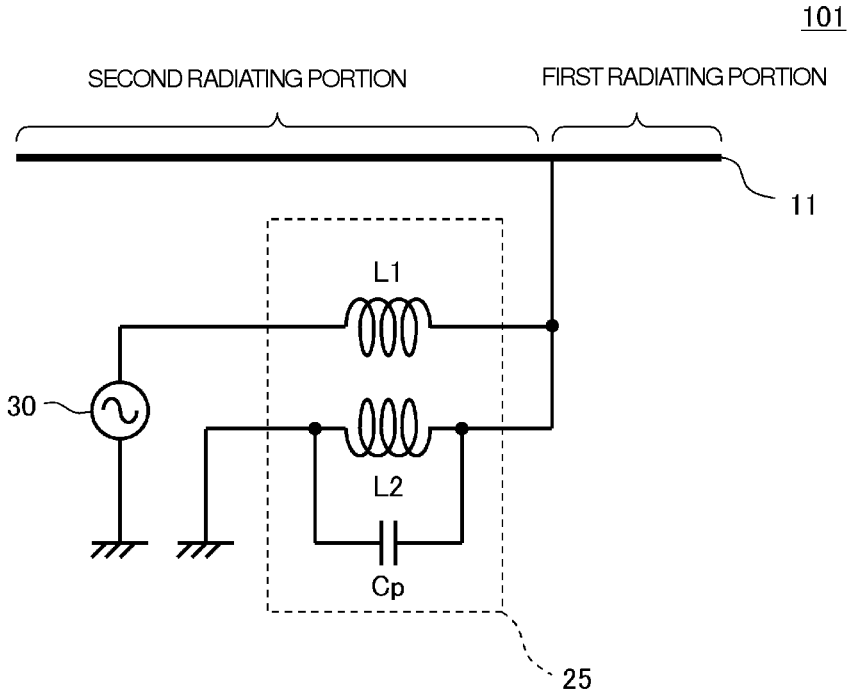
FIG. 5 is a circuit diagram of a multiband antenna device.

Although a description has been provided of a case in which the antenna element preferably is a monopole antenna, the antenna element may be another type of antenna such as illustrated in FIG. 5. FIG. 5 is a circuit diagram of a multiband antenna device 101. This antenna device 101 is preferably an antenna device to be used in a multiband mobile wireless communication system (800 MHz band, 900 MHz band, 1800 MHz band and 1900 MHz band) that is compatible with the GSM (registered trademark) scheme and the CDMA scheme. The antenna element 11 preferably is a branched monopole antenna, for example.

The antenna device 101 is preferably used as a main antenna of a communication terminal device, for example. A first radiating portion of the branched monopole antenna element 11 functions as a high-band-side antenna radiation element (i.e., 1800 to 2400 MHz band) and both of the first radiating portion and a second radiating portion function as a low-band-side antenna element (i.e., 800 to 900 MHz band). Here, the branched monopole antenna element 11 does not necessarily have to resonate within these respective frequency bands. This is because the impedance conversion device 25 causes a characteristic impedance of each of the radiating portions to match the impedance of the feeder circuit 30. The impedance conversion device 25, for example, preferably causes the characteristic impedances of the first radiating portion and the second radiating portion to match the impedance of the feeder circuit 30 (normally about 50Ω). Thus, a low-band high-frequency signal supplied from the feeder circuit 30 is caused to be radiated from the first radiation portion and the second radiating portion, or a low-band high-frequency signal received by the first radiating portion and the second radiating portion can be supplied to the feeder circuit 30. Similarly, a high-band high-frequency signal supplied from the feeder circuit 30 is caused to be radiated from the first radiating portion, or a high-band high-frequency signal received by the first radiating portion can be supplied to the feeder circuit 30.

According to the first preferred embodiment, the impedance conversion device 25 can simultaneously achieve impedance matching for the radiation resistance of the antenna corresponding to a change in frequency and achieve a negative inductance value that matches an equivalent inductance of the antenna, and therefore, matching can be performed over a wide frequency band for an antenna having various impedances and a communication device can be provided in which there is small loss between a circuit and an antenna even in the case in which wide band communication or multiband communication is performed or in which a plurality of systems share the same antenna. In addition, a matching adjusting element, such as an inductance element, a capacitance element, or a filter element, can preferably be added between the impedance conversion device and the antenna or the high-frequency circuit, so that fine adjustment of impedance matching may be further performed.

Second Preferred Embodiment

Figure 6A:
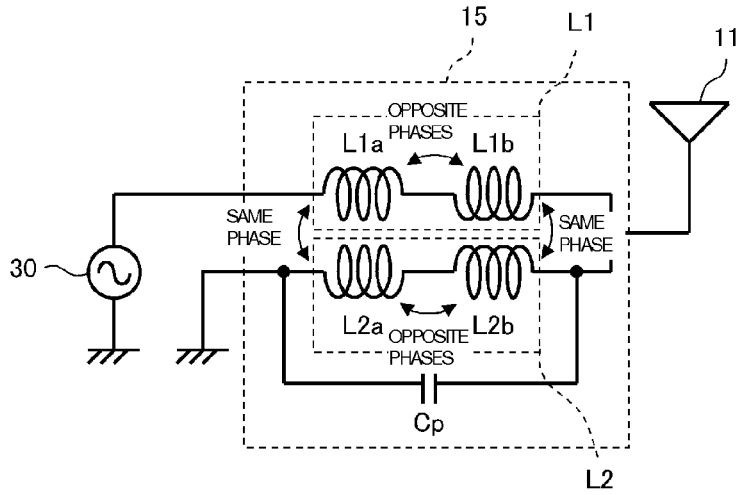
FIG. 6A is a circuit diagram of an antenna device of a second preferred embodiment of the present invention.

FIG. 6A is a circuit diagram of an impedance conversion device 15 of a second preferred embodiment of the present invention and an antenna device including the impedance conversion device 15. In the impedance conversion device 15, the first inductance element L1 and the second inductance element L2 of the impedance conversion device 25 of the first preferred embodiment are each divided into two inductance elements and these inductance elements are arranged so that their respective mutual inductances exhibit the relationship illustrated in FIG. 6A.

Figure 6B:
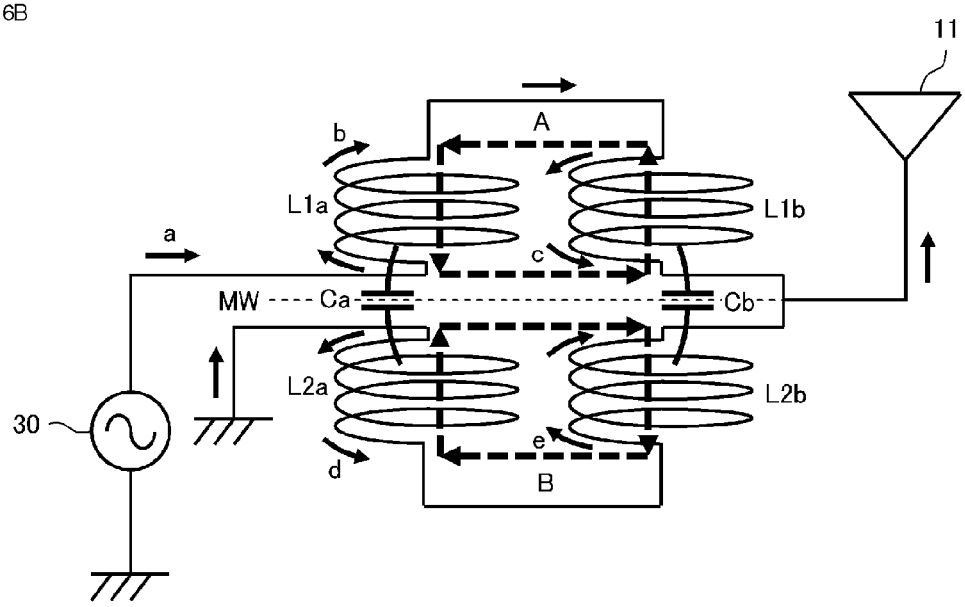
FIG. 6B is a diagram to which various arrows have been added to illustrate the states of magnetic field coupling and electric field coupling in the circuit illustrated in FIG. 6A.

FIG. 6B is a diagram to which various arrows have been added to illustrate the state of magnetic field coupling and electric field coupling in the circuit illustrated in FIG. 6A. As illustrated in FIG. 6B, when a current is supplied in the direction of arrow a in the figure from the feeder circuit, a current flows through a first coil element L1*a* in the direction of arrow b in the figure, and a current flows through a second coil element L1*b* in the direction of arrow c in the figure. Then, due to these currents, magnetic flux flowing through a closed magnetic circuit is generated as indicated by arrow A in FIG. 6B.

Since the coil element L1*a* and a coil element L2*a* are arranged in parallel or substantially in parallel with each other, the magnetic field generated by a current b flowing through the coil element L1*a* is coupled with the coil element L2*a*, and an induced current d flows in an opposite direction through the coil element L2*a*. Similarly, since the coil element L1*b* and a coil element L2*b* are arranged in parallel or substantially in parallel with each other, the magnetic field generated by a current c flowing through the coil element L1*b* is coupled with the coil element L2*b*, and an induced current e flows in an opposite direction through the coil element L2*b*. Then, due to these currents, magnetic flux flowing through a closed magnetic circuit is generated as indicated by arrow B in FIG. 6B.

The closed magnetic circuit of magnetic flux A generated by the first inductance element L1 including the coil elements L1*a* and L1*b*, and the closed magnetic circuit of magnetic flux B generated by the second inductance element L2 including the coil elements L2*a* and L2*b* are independent of each other and, therefore, an equivalent magnetic wall MW is generated between the first inductance element L1 and the second inductance element L2.

In addition, the coil element L1*a* and the coil element L2*a* are also coupled by an electric field. Similarly, the coil element L1*b* and the coil element L2*b* are also coupled by an electric field. Therefore, when an alternating current signal flows through the coil element L1*a* and the coil element L1*b*, currents are excited in the coil element L2*a* and the coil element L2*b* due to electric field coupling. Capacitors Ca and Cb illustrated in FIG. 6B symbolically represent coupling capacitances for the electric field coupling.

When an alternating current flows through the first inductance element L1, the direction of a current flowing through the second inductance element L2 due to coupling via the magnetic field and the direction of a current flowing through the second inductance element L2 due to coupling via the electric field are the same. Therefore, the first inductance element L1 and the second inductance element L2 are strongly coupled through both a magnetic field and an electric field. That is, loss can be reduced and high-frequency energy can be generated and propagated.

It can also be said that the impedance conversion device 15 is a circuit that is configured such that, when an alternating current flows through the first inductance element L1, the direction in which a current flows through the second inductance element L2 due to coupling via the magnetic field and the direction in which a current flows through the second inductance element L2 due to coupling via the electric field are the same.

As a result of the thus-obtained effect, the device functions as a transformer in which coupling is stronger and loss is smaller, and therefore, an impedance conversion transformer having a small loss is obtained and a large mutual inductance is obtained. In addition, the capacitor Cp can preferably be obtained by arranging L2*a* and L2*b* at positions close to the ground conductor. Therefore, with the configuration illustrated in FIGS. 6A and 6B, similarly to the first preferred embodiment, impedance conversion and matching can be performed with smaller loss.

Figure 7A:
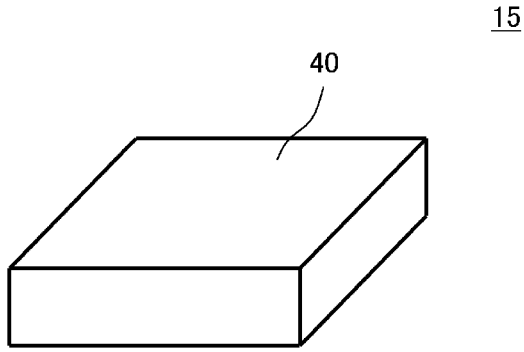
FIG. 7A is a perspective view of an impedance conversion device of the second preferred embodiment of the present invention and FIG. 7B is a perspective view of the same seen from the lower surface side of the impedance conversion device.
Figure 7B:
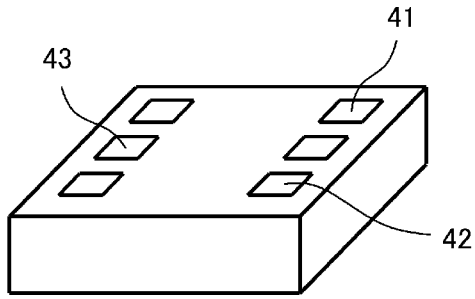

FIG. 7A is a perspective view of an impedance conversion device of the second preferred embodiment of the present invention and FIG. 7B is a perspective view of the same seen from the lower surface side of the impedance conversion device. In addition, FIG. 8 is an exploded perspective view of a multilayer body 40 of the impedance conversion device 15.

Figure 8:
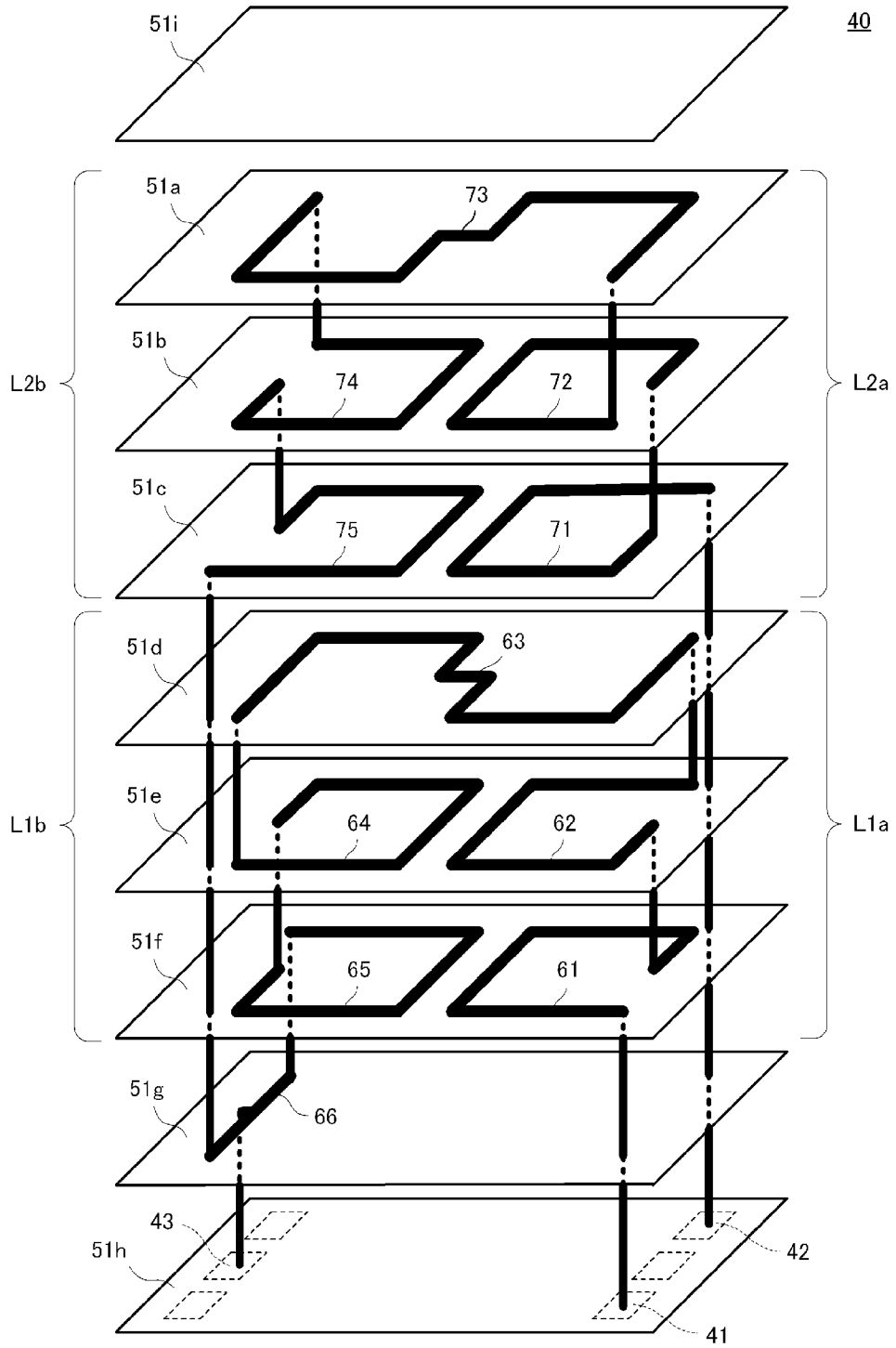
FIG. 8 is an exploded perspective view of a multilayer body that defines an impedance conversion device.

As illustrated in FIG. 8, each substrate layer is preferably made of a magnetic sheet, for example, and conductor patterns are provided on each of the layers. In the region illustrated in FIG. 8, a conductor pattern 73 is provided on a substrate layer 51*a*, conductor patterns 72 and are provided on a substrate layer 51*b*, and conductor patterns 71 and 75 are provided on a substrate layer 51*c*. A conductor pattern 63 is provided on a substrate layer 51*d*, conductor patterns 62 and 64 are provided on a substrate layer 51*e* and conductor patterns 61 and 65 are provided on a substrate layer 51*f*. A conductor pattern 66 is provided on a substrate layer 51*g* and a feeder terminal 41, a ground terminal 42, and an antenna terminal 43 are provided on a substrate layer 51*h*. Lines extending in the vertical direction in FIG. 8 represent via electrodes and the via electrodes connect the conductor patterns to each other between the layers.

In FIG. 8, the first coil element L1*a* is defined by the right half of the conductor pattern 63 and the conductor patterns 61 and 62. In addition, the second coil element L1*b* is defined by the left half of the conductor pattern 63 and the conductor patterns 64 and 65. In addition, the third coil element L2*a* is defined by the right half of the conductor pattern 73 and the conductor patterns and 72. In addition, the fourth coil element L2*b* is defined by the left half of the conductor pattern 73 and the conductor patterns 74 and 75. The winding axes of the coil elements L1*a*, L1*b*, L2*a* and L2*b* are parallel or substantially parallel to the stacking direction of the multilayer substrate. The winding axes of the first coil element L1*a* and the second coil element L1*b* are arranged side by side so as to be at different positions from each other. Similarly, the winding axes of the third coil element L2*a* and the fourth coil element L2*b* are arranged side by side so as to be at different positions from each other. The winding regions of the first coil element L1*a* and the third coil element L2*a* are at least partially superposed with each other when viewed in plan and the winding regions of the second coil element L1*b* and the fourth coil element L2*b* are at least partially superposed with each other when viewed in plan. In this example, these winding regions are preferably substantially completely superposed with each other. Thus, four coil elements are defined by conductor patterns arranged in a figure eight shape.

The individual layers may preferably be made of dielectric sheets, for example. That is, if magnetic sheets having a high relative magnetic permeability are used, the coefficient of coupling between the coil elements can be more greatly increased.

Figure 9:
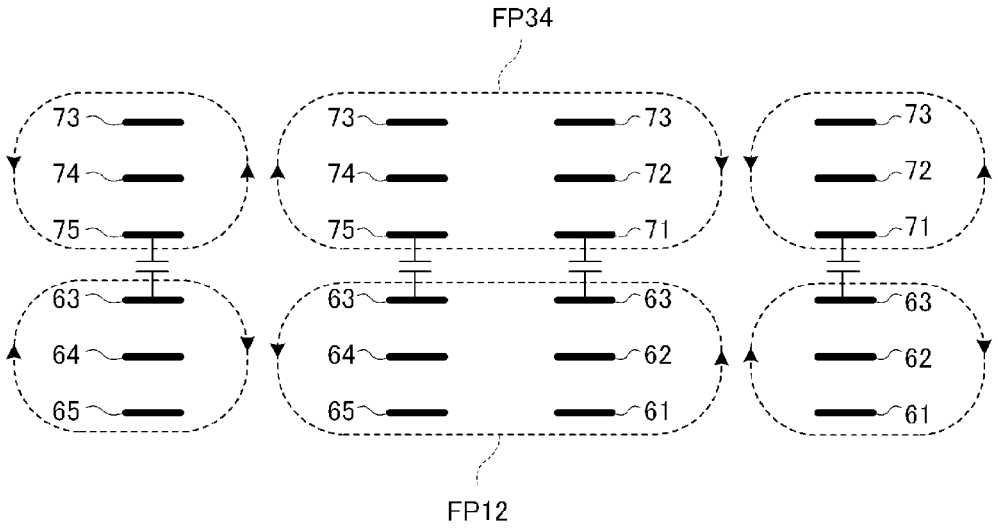
FIG. 9 illustrates the principal lines of magnetic flux that flow around coil elements defined by conductor patterns provided on individual layers of the multilayer substrate illustrated in FIG. 8.

FIG. 9 illustrates the principle lines of magnetic flux that flow around coil elements defined by conductor patterns provided on individual layers of a multilayer substrate illustrated in FIG. 8. Magnetic flux FP12 flows around the first coil element L1*a* defined by the conductor patterns 61 to 63 and flows around the second coil element L1*b* defined by the conductor patterns 63 to 65. In addition, magnetic flux FP34 flows around the third coil element L2*a* defined by the conductor patterns 71 to 73 and flows around the fourth coil element L2*b* defined by the conductor patterns 73 to 75.

Figure 10:
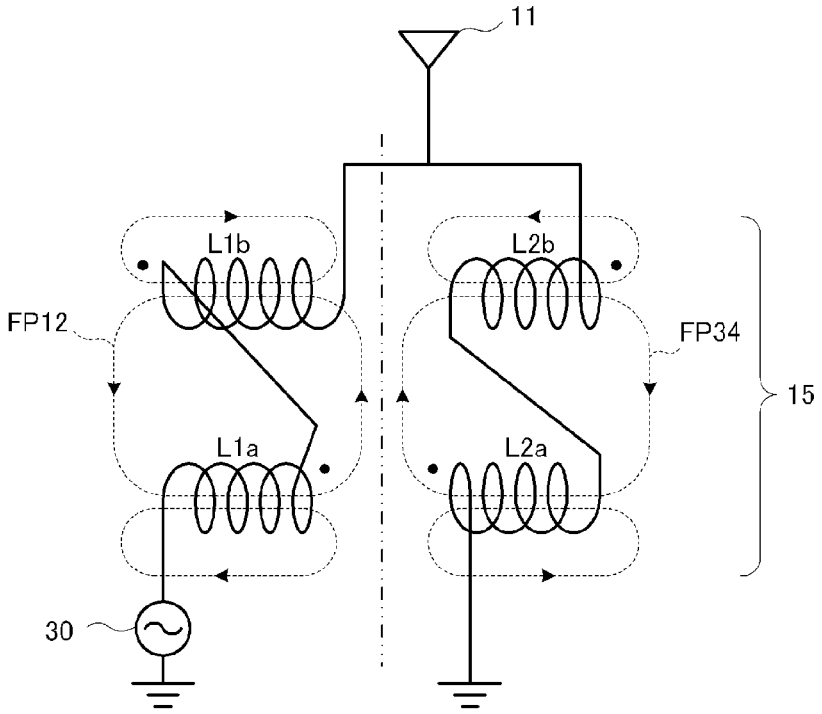
FIG. 10 illustrates the relationships of magnetic coupling between four coil elements of an impedance conversion device according to the second preferred embodiment of the present invention.

FIG. 10 illustrates the relationships of magnetic coupling between the four coil elements L1*a*, L1*b*, L2*a* and L2*b* of the impedance conversion device 15 according to the second preferred embodiment. Thus, the first coil element L1*a* and the second coil element L1*b* are wound such that a first closed magnetic circuit (loop represented by magnetic flux FP12) is defined by the first coil element L1*a* and the second coil element L1*b*, and the third coil element L2*a* and the fourth coil element L2*b* are wound such that a second closed magnetic circuit (loop represented by magnetic flux FP34) is defined by the third coil element L2*a* and the fourth coil element L2*b*. In this manner, the four coil elements L1*a*, L1*b*, L2*a*, and L2*b* are preferably wound such that the magnetic flux FP12 flowing though the first closed magnetic circuit and the magnetic flux FP34 flowing through the second closed magnetic circuit circulate in opposite directions. The two-dot chain line in FIG. 10 represents a magnetic wall that the magnetic flux FP12 and the magnetic flux FP34 do not cross. Thus, a magnetic wall is generated between the coil elements L1*a* and L2*a* and between the coil elements L1*b* and L2*b*.

Third Preferred Embodiment

Figure 11:
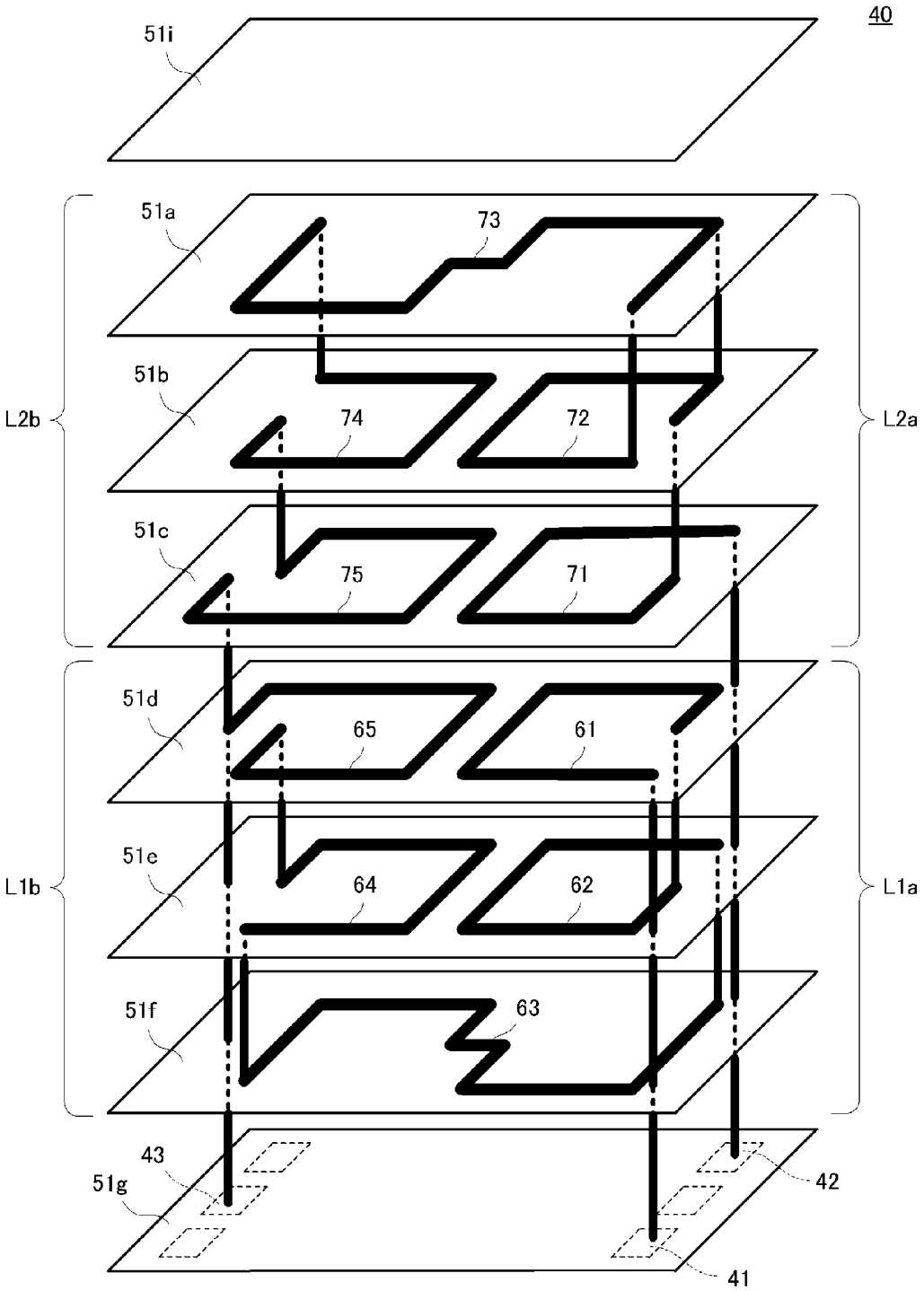
FIG. 11 illustrates the structure of an impedance conversion device according to a third preferred embodiment of the present invention.

FIG. 11 illustrates the structure of an impedance conversion device according to a third preferred embodiment of the present invention. In the region illustrated in FIG. 11, a conductor pattern 73 is provided on a substrate layer 51*a*, conductor patterns 72 and 74 are provided on a substrate layer 51*b* and conductor patterns 71 and 75 are provided on a substrate layer 51*c*. A conductor pattern 63 is provided on a substrate layer 51*f*, conductor patterns 62 and 64 are provided on a substrate layer 51*e* and conductor patterns 61 and 65 are provided on a substrate layer 51*d*. A feeder terminal 41, a ground terminal 42, and an antenna terminal 43 are provided on a lower surface of a substrate layer 51*g*. Lines extending in the vertical direction in FIG. 11 represent via electrodes and the via electrodes connect the conductor patterns to each other between the layers.

In FIG. 11, a first coil element L1*a* is defined by the right half of the conductor pattern 63 and the conductor patterns 61 and 62. In addition, a second coil element L1*b* is defined by the left half of the conductor pattern 63 and the conductor patterns 64 and 65. In addition, a third coil element L2*a* is defined by the right half of the conductor pattern 73 and the conductor patterns 71 and 72. In addition, a fourth coil element L2*b* is defined by the left half of the conductor pattern 73 and the conductor patterns 74 and 75.

Figure 12:
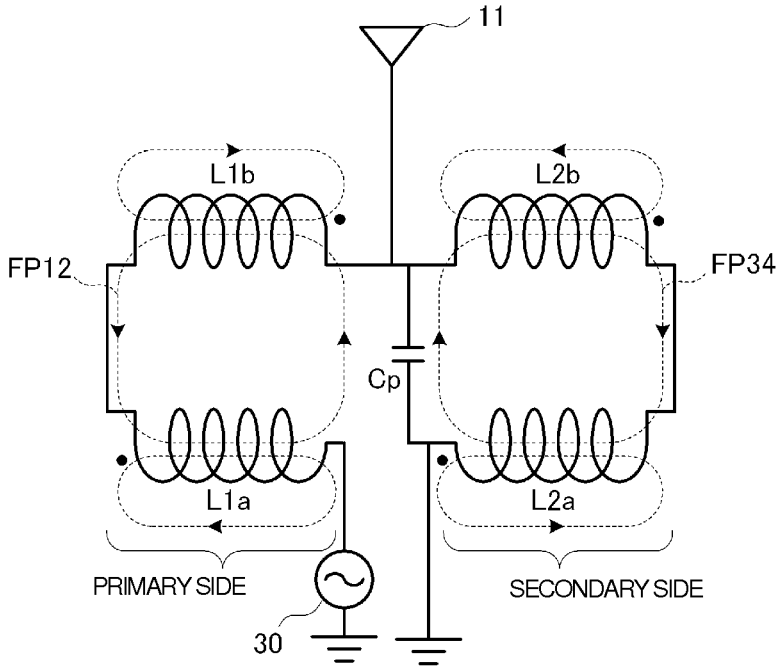
FIG. 12 illustrates the relationships of magnetic coupling between four coil elements of an impedance conversion device according to the third preferred embodiment of the present invention.

FIG. 12 illustrates the relationships of magnetic coupling between the four coil elements L1*a*, L1*b*, L2*a* and L2*b* of the impedance conversion device according to the third preferred embodiment. Thus, a first closed magnetic circuit (loop represented by magnetic flux FP12) is defined by the first coil element L1*a* and the second coil element L1*b*. In addition, a second closed magnetic circuit (loop represented by magnetic flux FP34) is defined by the third coil element L2*a* and the fourth coil element L2*b*. The direction in which the magnetic flux FP12 flows through the first closed magnetic circuit and the direction in which the magnetic flux FP34 flows through the second closed magnetic circuit are opposite to each other.

Here, if the first coil element L1*a* and the second coil element L1*b* are referred as a "primary side" and the third coil element L2*a* and the fourth coil element L2*b* are referred to as a "secondary side", as illustrated in FIG. 12, since the feeder circuit is connected so as to be close to the secondary side on the primary side, a potential on the primary side in the vicinity of the secondary side can be increased, and electric field coupling between the coil element L1*a* and the coil element L2*a* is increased and the current induced by this electric field coupling is increased.

With the configuration according to the third preferred embodiment, since the inductance values of the coil elements L1*a* and L1*b* and the coil elements L2*a* and L2*b* are reduced due to being coupled with one another, the impedance conversion device described in the third preferred embodiment achieves the same or substantially the same effect as the impedance conversion device of the second preferred embodiment.

Fourth Preferred Embodiment

Figure 13:
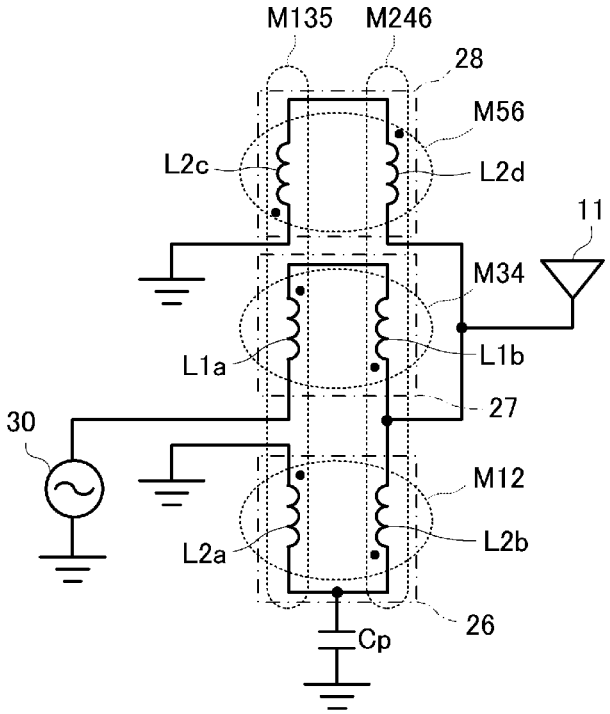
FIG. 13 is a circuit diagram of an impedance conversion device according to a fourth preferred embodiment of the present invention.

FIG. 13 is a circuit diagram of an impedance conversion device according to a fourth preferred embodiment of the present invention. This impedance conversion device includes a second series circuit 27 connected between a feeder circuit 30 and an antenna element 11 and first and third series circuits 26 and 28 connected between the antenna element 11 and the ground.

In the second series circuit 27, a first coil element L1*a* and a second coil element L1*b* are connected in series with each other. In the first series circuit 26, a third coil element L2*a* and a fourth coil element L2*b* are connected in series with each other. In the third series circuit 28, another third coil element L2*c* and another fourth coil element L2*d* are connected in series with each other.

In FIG. 13, an enclosure M34 represents coupling of the coil elements L1*a* and L1*b*, an enclosure M12 represents coupling of the coil elements L2*a* and L2*b*, and an enclosure M56 represents coupling of the coil elements L2*c* and L2*d*. In addition, an enclosure M135 represents coupling of the coil elements L1*a*, L2*a* and L2*c*. Similarly, an enclosure M246 represents coupling of the coil elements L1*b*, L2*b* and L2*d*.

Figure 14:
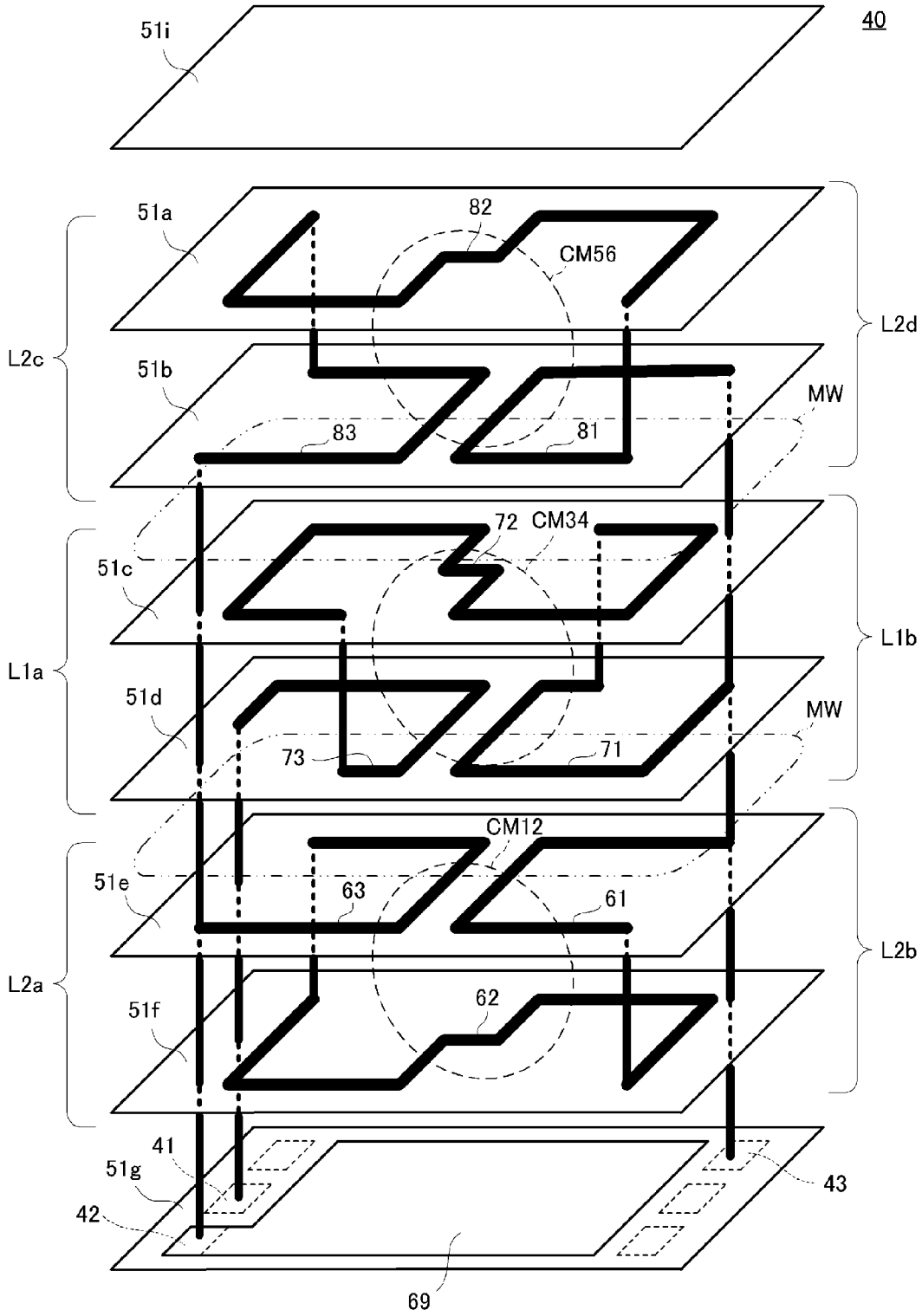
FIG. 14 illustrates an example of conductor patterns of individual layers in the case in which the impedance conversion device according to the fourth preferred embodiment of the present invention is provided in a multilayer substrate.

FIG. 14 illustrates an example of conductor patterns of individual layers in the case in which the impedance conversion device according to a fourth preferred embodiment is provided in a multilayer substrate. Each layer is preferably made of a magnetic sheet and conductor patterns are provided on each of the layers.

In the region illustrated in FIG. 14, a conductor pattern 82 is provided on a substrate layer 51*a*, conductor patterns 81 and 83 are provided on a substrate layer 51*b* and a conductor pattern 72 is provided on a substrate layer 51*c*. Conductor patterns 71 and 73 are provided on a substrate layer 51*d*, conductor patterns 61 and 63 are provided on a substrate layer 51*e* and a conductor pattern 62 is provided on a substrate layer 51*f*. A ground conductor 69 is provided on the upper surface of a substrate layer 51*g*. A feeder terminal 41, a ground terminal 42, and an antenna terminal 43 are provided on a lower surface of the substrate layer 51*g*. Broken lines extending in the vertical direction in FIG. 14 represent via electrodes and the via electrodes connect the conductor patterns to each other between the layers.

In FIG. 14, the fourth coil element L2*b* is defined by the right half of the conductor pattern 62 and the conductor pattern 61. In addition, the third coil element L2*a* is defined by the left half of the conductor pattern 62 and the conductor pattern 63. In addition, the second coil element L1*b* is defined by the conductor pattern 71 and the right half of the conductor pattern 72. In addition, the first coil element L1*a* is defined by the left half of the conductor pattern 72 and the conductor pattern 73. In addition, the other fourth coil element L2*d* is defined by the conductor pattern 81 and the right half of the conductor pattern 82. In addition, the other third coil element L2*c* is defined by the left half of the conductor pattern 82 and the conductor pattern 83.

A capacitor Cp illustrated in FIG. 13 is generated between the conductor pattern 62 and the ground conductor 69.

In FIG. 14, broken line ellipsoidal shapes represent closed magnetic circuits. A closed magnetic circuit CM12 connects the coil elements L2*a* and L2*b*. In addition, a closed magnetic circuit CM34 connects the coil elements L1*a* and L1*b*. Moreover, a closed magnetic circuit CM56 connects the coil elements L2*c* and L2*d*. Thus, a first closed magnetic circuit CM12 is defined by the third coil element L2*a* and the fourth coil element L2*b*, a second closed magnetic circuit CM34 is defined by the first coil element L1*a* and the second coil element L1*b*, and a third closed magnetic circuit CM56 is defined by the third coil element L2*c* and the fourth coil element L2*d*. In FIG. 14, the planes indicated by the two-dot chain line represent two magnetic walls MW equivalently generated between the three closed magnetic circuits due to the coil elements L1*a* and L2*a*, the coil elements L1*a* and L2*c*, the coil elements L1*b* and L2*b*, and the coil elements L1*b* and L2*d* coupling with each other such that the magnetic flux generated by the coil elements in respective pairs flow in opposite directions. In other words, magnetic flux of the closed magnetic circuit defined by the coil elements L1*a* and L1*b*, magnetic flux of the closed magnetic circuit defined by the coil elements L2*a* and L2*b*, and magnetic flux of the closed magnetic circuit defined by the coil elements L2*c* and L2*d* are confined by the two magnetic walls MW.

Thus, a structure is provided in which the second closed magnetic circuit CM34 is interposed between the first closed magnetic circuit CM12 and the third closed magnetic circuit CM56 in the stacking direction. With this structure, the second closed magnetic circuit CM34 is interposed between the two magnetic walls and sufficiently confined, such that confinement effect is increased. That is, the impedance conversion device can operate as a transformer having a very large coupling coefficient.

Therefore, the distance between the closed magnetic circuits CM12 and CM34 and the distance between the closed magnetic circuits CM34 and CM56 can be increased to a certain extent. Thus, the capacitance generated between the first series circuit 26 and the second series circuit 27 and the capacitance generated between the second series circuit 27 and the third series circuit 28 illustrated in FIG. 13 can be reduced. That is, the capacitance component of an LC resonant circuit that determines the frequency of a self-resonant point is reduced.

In addition, according to the fourth preferred embodiment, since a structure is provided in which the first series circuit 26 including the coil elements L2*a* and L2*b* and the third series circuit 28 including the coil elements L2*c* and L2*d* are connected in parallel with each other, the inductance component of an LC resonant circuit that determines the frequency of a self-resonant point is reduced.

Thus, the capacitance component and the inductance component of an LC resonant circuit that determine the frequency of a self-resonant point are both reduced and a high frequency that is sufficiently separated from the used frequency band can be determined as the frequency of the self resonant point.

In addition, in the fourth preferred embodiment, the first inductance elements L1*a* and L1*b* are preferably arranged so as to be interposed between the second inductance elements L2*a*, L2*b*, L2*c* and L2*d* and as a result stray capacitances generated between the first inductance elements L1*a* and L1*b* and the ground are reduced or prevented. Such capacitance components that do not contribute to radiation are preferably reduced or prevented and, as a result, the radiation efficiency of the antenna is increased.

In addition, the first inductance elements L1*a* and L1*b* and the second inductance elements L2*a*, L2*b*, L2*c* and L2*d* are more closely coupled, that is, magnetic field leakage is reduced, and the energy propagation loss of a high frequency signal between the first inductance elements L1*a* and L1*b* and the second inductance elements L2*a*, L2*b*, L2*c* and L2*d* is reduced.

Moreover, the majority of the coil elements L1*a* and L1*b* of the first inductance element and the majority of the coil elements L2*a* and L2*b* of the second inductance element are preferably superposed with each other when viewed in plan. Consequently, the coil elements L2*a* and L2*b* prevent the generation of capacitances between the coil elements L1*a* and L1*b* and the ground conductor 69. Thus, it is possible to ensure that the frequency characteristics of the real portion of the impedance of the first circuit including the first inductance elements L1*a* and L1*b* remain constant or substantially constant, while the frequency characteristics of the real portion of the impedance of the second circuit including the second inductance elements (L2*a*, L2*b*, L2*c* and L2*d*) and the capacitance Cp effectively change.

Fifth Preferred Embodiment

Figure 15:
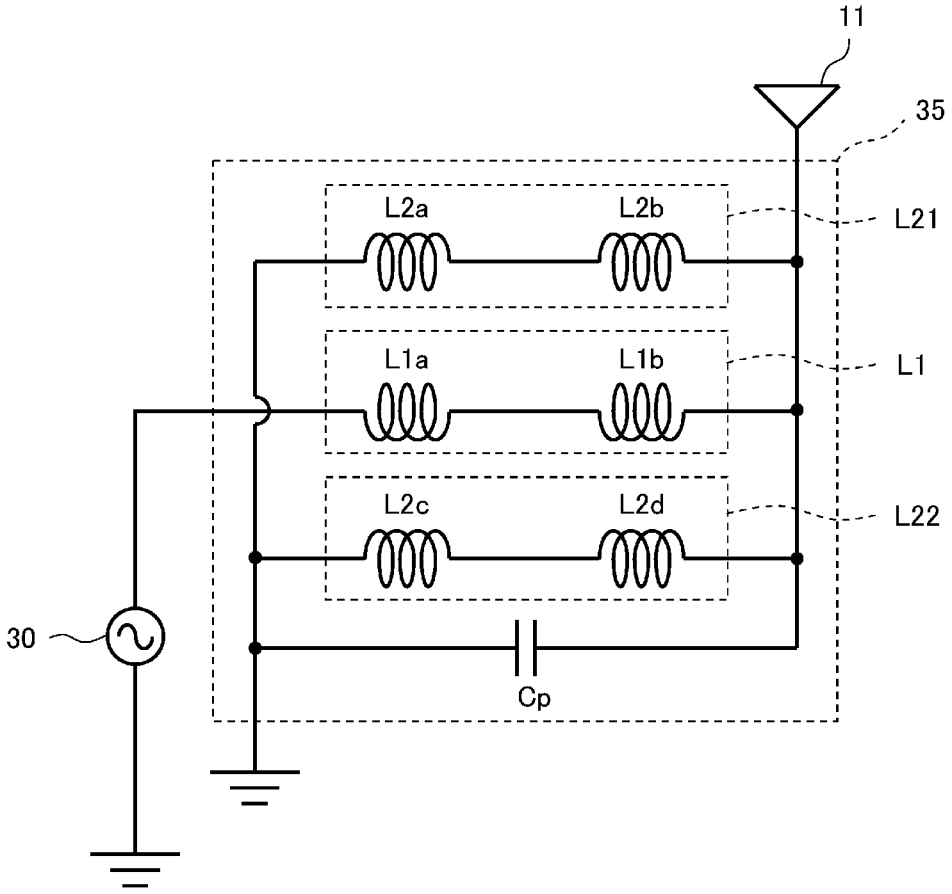
FIG. 15 is a circuit diagram of an antenna device of a fifth preferred embodiment of the present invention.

FIG. 15 is a circuit diagram of an antenna device of a fifth preferred embodiment of the present invention. An impedance conversion device 35 includes a first inductance element L1 and two second inductance elements L21 and L22. The first inductance element L1 is defined by a first coil element L1*a* and a second coil element L1*b*. The second inductance element L21 is defined by a third coil element L2*a* and a fourth coil element L2*b*. In addition, the other second inductance element L22 is defined by a third coil element L2*c* and a fourth coil element Ltd.

In contrast to the circuit illustrated in FIG. 13, in the fifth preferred embodiment, a capacitor Cp is preferably provided that is connected in parallel with the second inductance elements L21 and L22 as a separate element.

Figure 16:
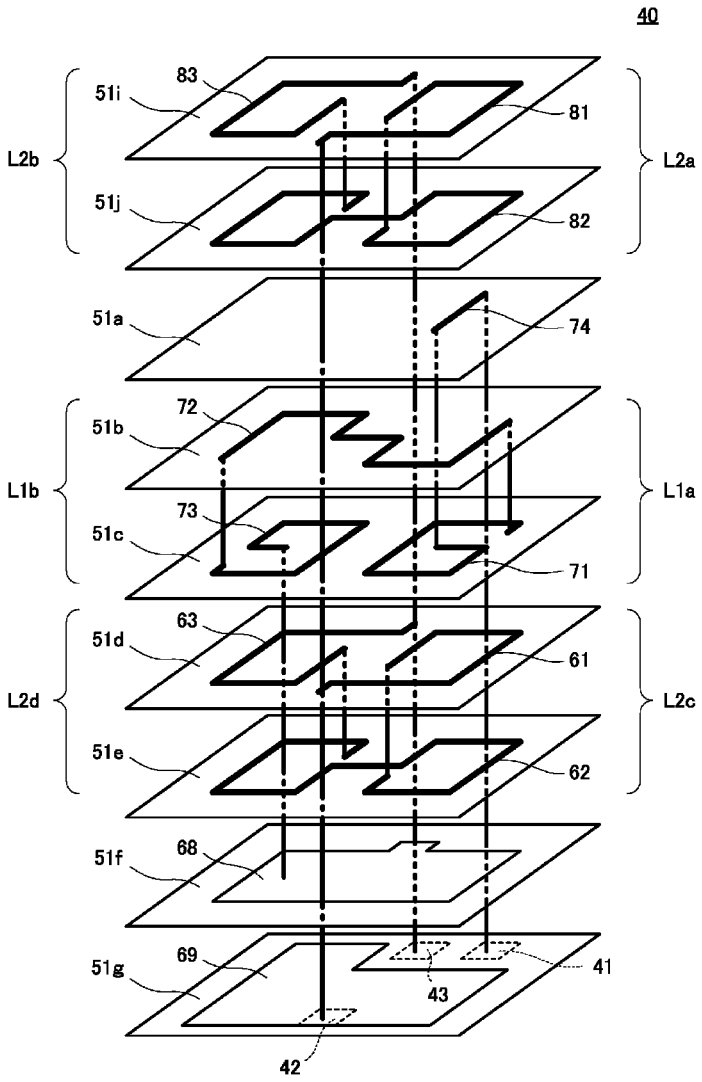
FIG. 16 is an exploded perspective view of a multilayer body that defines an impedance conversion device.

FIG. 16 is an exploded perspective view of a multilayer body 40 that defines the impedance conversion device 35. Each layer is preferably made of a magnetic sheet and conductor patterns are provided on each of the layers.

In the region illustrated in FIG. 16, conductor patterns 81 and 83 are provided on a substrate layer 51*i*, a conductor pattern 82 is provided on a substrate layer 51*j* and a conductor pattern 74 is provided on a substrate layer 51*a*. A conductor pattern 72 is provided on a substrate layer 51*b* and conductor patterns 71 and 73 are provided on a substrate layer 51*c*. Conductor patterns 61 and 63 are provided on a substrate layer 51*d*, a conductor pattern 62 is provided on a substrate layer 51*e* and a conductor pattern 68 is provided on a substrate layer 51*f*. A ground conductor 69 is provided on the upper surface of a substrate layer 51*g* and a feeder terminal 41, a ground terminal 42, and an antenna terminal 43 are provided on the lower surface of the substrate layer 51*g*. Broken lines extending in the vertical direction in FIG. 16 represent via electrodes and the via electrodes connect the conductor patterns to each other between the layers.

In FIG. 16, the first coil element L1*a* is defined by the right half of the conductor pattern 72 and the conductor pattern 71. In addition, the second coil element L1*b* is defined by the left half of the conductor pattern 72 and the conductor pattern 73. In addition, the third coil element L2*a* is defined by the conductor pattern 81 and the right half of the conductor pattern 82. In addition, the fourth coil element L2*b* is defined by the left half of the conductor pattern 82 and the conductor pattern 83. In addition, the other third coil element L2*c* is defined by the conductor pattern 61 and the right half of the conductor pattern 62. In addition, the other fourth coil element L2*d* is defined by the left half of the conductor pattern 62 and the conductor pattern 63.

The capacitor Cp illustrated in FIG. 15 is generated as a result of the conductor pattern 68 and the ground conductor 69 opposing each other.

Sixth Preferred Embodiment

Figure 17:
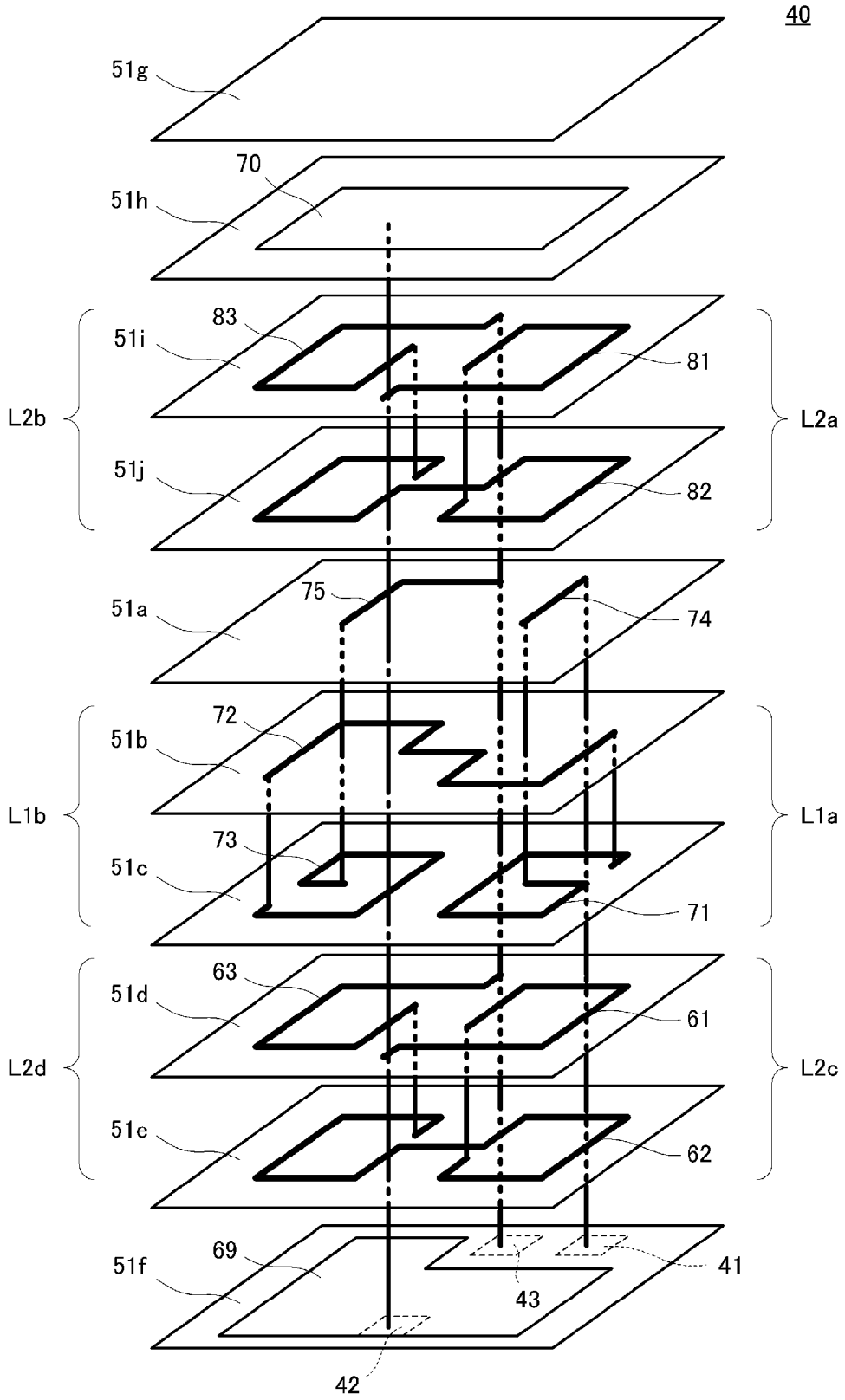
FIG. 17 is an exploded perspective view of a multilayer body that defines an impedance conversion device, which is included in an antenna device, of a sixth preferred embodiment of the present invention.

FIG. 17 is an exploded perspective view of a multilayer body 40 that defines an impedance conversion device, which is included in an antenna device, of a sixth preferred embodiment of the present invention. Each layer is preferably made of a magnetic sheet and conductor patterns are provided on each of the layers.

In the region illustrated in FIG. 17, conductor patterns 81 and 83 are provided on a substrate layer 51*i*, a conductor pattern 82 is provided on a substrate layer 51*j* and conductor patterns 74 and 75 are provided on a substrate layer 51*a*. A conductor pattern 72 is provided on a substrate layer 51*b* and conductor patterns 71 and 73 are provided on a substrate layer 51*c*. Conductor patterns 61 and 63 are provided on a substrate layer 51*d*, a conductor pattern 62 is provided on a substrate layer 51*e* and a ground conductor 70 is provided on a substrate layer 51*h*. A ground conductor 69 is provided on the upper surface of a substrate layer 51*f* and a feeder terminal 41, a ground terminal 42, and an antenna terminal 43 are provided on the lower surface of the substrate layer 51*f*. Broken lines extending in the vertical direction in FIG. 17 represent via electrodes and the via electrodes connect the conductor patterns to each other between the layers.

In FIG. 17, a first coil element L1*a* is defined by the right half of the conductor pattern 72 and the conductor pattern 71. In addition, a second coil element L1*b* is defined by the left half of the conductor pattern 72 and the conductor pattern 73. In addition, a third coil element L2*a* is defined by the conductor pattern 81 and the right half of the conductor pattern 82. In addition, a fourth coil element L2*b* is defined by the left half of the conductor pattern 82 and the conductor pattern 83. In addition, another third coil element L2*c* is defined by the conductor pattern 61 and the right half of the conductor pattern 62. In addition, another fourth coil element L2*d* is defined by the left half of the conductor pattern 62 and the conductor pattern 63.

The ground conductor 69 and the conductor pattern 62 preferably oppose each other such that a capacitance is generated therebetween. In addition, the ground conductor 70 and the conductor patterns 81 and 83 preferably oppose each other such that capacitances are generated therebetween.

A circuit diagram of an antenna device including the impedance conversion device according to the sixth preferred embodiment is preferably the same or substantially the same as that illustrated in FIG. 15. The capacitance generated between the ground conductor 69 and the conductor pattern 62 and the capacitances generated between the ground conductor 70 and the conductor patterns 81 and 83 correspond to the capacitor Cp illustrated in FIG. 15.

In the sixth preferred embodiment, a structure is provided in which each of the conductor patterns provided on the plurality of layers is interposed between the ground conductors 69 and 70 such that unwanted coupling between outside conductors and the circuit is prevented even if the overall thickness of the multilayer body is reduced, and therefore, stable characteristics are obtained and a reduction in thickness is achieved. In addition, even if a surface mount component is mounted on the upper surface of the multilayer body, there is no effect on the impedance conversion characteristics due to the ground conductor 70 being provided on the upper layer of the multilayer body. Consequently, a module component can be formed by mounting various chip components on the multilayer body.

Seventh Preferred Embodiment

Figure 18:
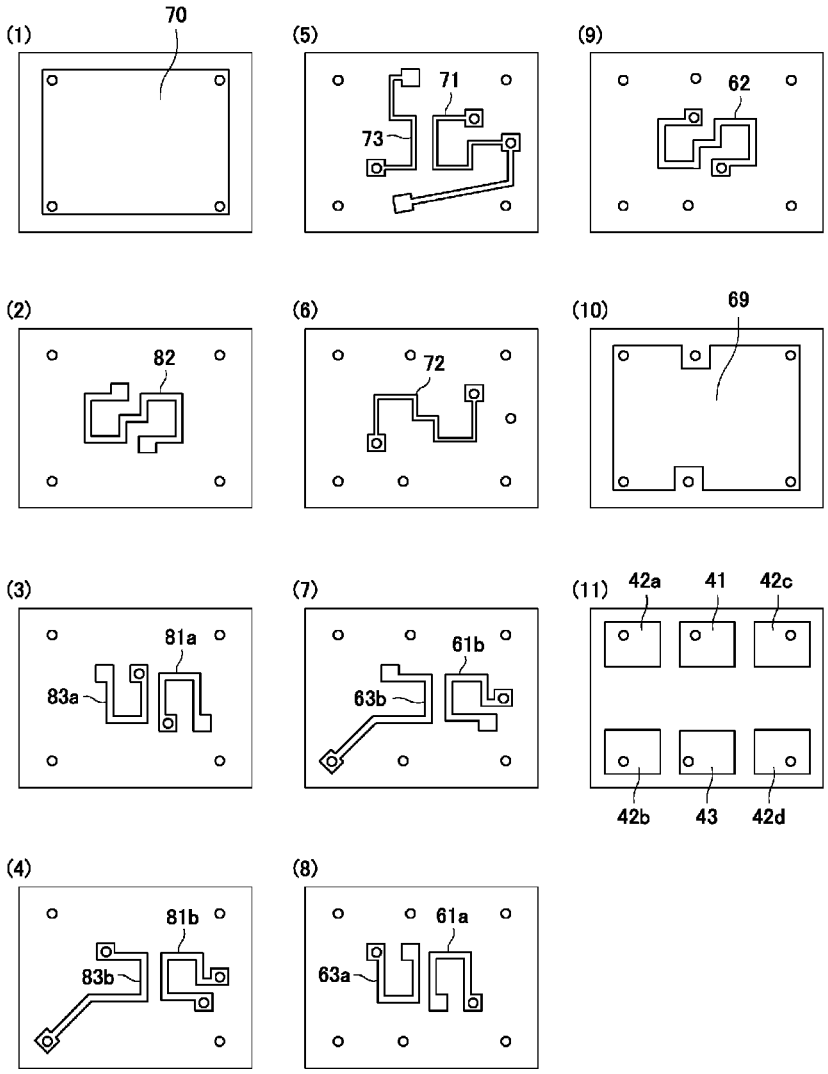
FIG. 18 is an exploded plan view of a multilayer body that defines an impedance conversion device, which is included in an antenna device, of a seventh preferred embodiment of the present invention.

FIG. 18 is an exploded plan view of a multilayer body that defines an impedance conversion device, which is included in an antenna device, of a seventh preferred embodiment of the present invention. Each layer is preferably made of a magnetic sheet and conductor patterns are provided on each of the layers. In FIG. 18, a substrate layer (1) is an uppermost magnetic sheet and a substrate layer (11) is a lowermost magnetic sheet. Conductor patterns are provided on the lower surfaces of the magnetic sheets of the substrate layers (1) to (10). Outer electrode patterns are provided on the lowermost substrate layer (11), after the lowermost substrate layer (11) has been included in the multilayer body.

In FIG. 18, a ground conductor 70 is provided on the substrate layer (1) and a ground conductor 69 is provided on the substrate layer (10). A conductor pattern is provided on the substrate layer (2), conductor patterns 81*a* and 83*a* are provided on the substrate layer (3), conductor patterns 81*b* and 83*b* are provided on the substrate layer (4), conductor patterns 71 and 73 are provided on the substrate layer (5), a conductor pattern 72 is provided on the substrate layer (6), conductor patterns 61*b* and 63*b* are provided on the substrate layer (7), conductor patterns 61*a* and 63*a* are provided on the substrate layer (8), and a conductor pattern 62 is provided on the substrate layer (9). In addition, a feeder terminal 41, an antenna terminal 43, and ground terminals 42*a* to 42*d* are provided on the lower surface of the multilayer body.

The line width of the conductor patterns of the first and second coil elements 71, 72 and 73 that define a first inductance element is preferably less than or equal to the line width of the third and fourth coil elements (conductor patterns 61*a*, 61*b*, 62, 63*a*, 63*b*, 81*a*, 81*b*, 82, 83*a* and 83*b*) that defines a second inductance element. In addition, the conductor patterns that define third and fourth coil elements are preferably superposed with the conductor patterns of the first and second coil elements when viewed in plan. With this structure, stray capacitances between the first inductance element and the second inductance element are effectively prevented.

An equivalent circuit of the impedance matching circuit illustrated in FIG. 18 is preferably the same or substantially the same as that illustrated in FIG. 15. In FIG. 18, a first coil element L1*a* is defined by the right half of the conductor pattern 72 and the conductor pattern 71. In addition, a second coil element L1*b* is defined by the left half of the conductor pattern 72 and the conductor pattern 73. In addition, a third coil element L2*a* is defined by the conductor patterns 81*a* and 81*b* and the right half of the conductor pattern 82. In addition, a fourth coil element L2*b* is defined by the left half of the conductor pattern 82 and conductor patterns 83*a* and 83*b*. In addition, another third coil element L2*c* is defined by conductor patterns 61*a* and 61*b* and the right half of a conductor pattern 62. In addition, another fourth coil element L2*d* is defined by the left half of the conductor pattern 62 and conductor patterns 63*a* and 63*b*.

The ground conductor 69 and the conductor pattern 62 oppose each other such that a capacitance is generated therebetween. In addition, the ground conductor 70 and the conductor pattern 82 oppose each other such that a capacitance is generated therebetween.

A circuit diagram of an antenna device including the impedance conversion device according to the seventh preferred embodiment is preferably the same or substantially the same as that illustrated in FIG. 15. The capacitance generated between the ground conductor 69 and the conductor pattern 62 and the capacitance generated between the ground conductor 70 and the conductor pattern 82 correspond to the capacitor Cp illustrated in FIG. 15.

The various conductor patterns can preferably be made so that a main component thereof is a conductive material, such as silver or copper, for example. For the substrate layers, a dielectric material, such as a glass ceramic material or an epoxy resin material, for example, can be used or a magnetic material, such as a ferrite ceramic material or a resin material including a ferrite, for example can be used. As a material of the substrate layers, in particular, in the case in which a UHF band impedance conversion device is to be provided, it is preferable that a dielectric material be used and in the case in which a HF band impedance conversion device is to be provided, it is preferable that a magnetic material be used.

Eighth Preferred Embodiment

Figure 19A:
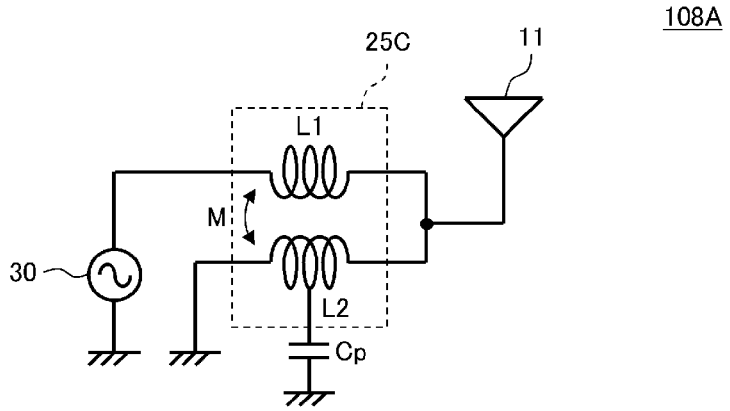
FIG. 19A is a circuit diagram of an antenna device according to a first example of an eighth preferred embodiment of the present invention.
Figure 19B:
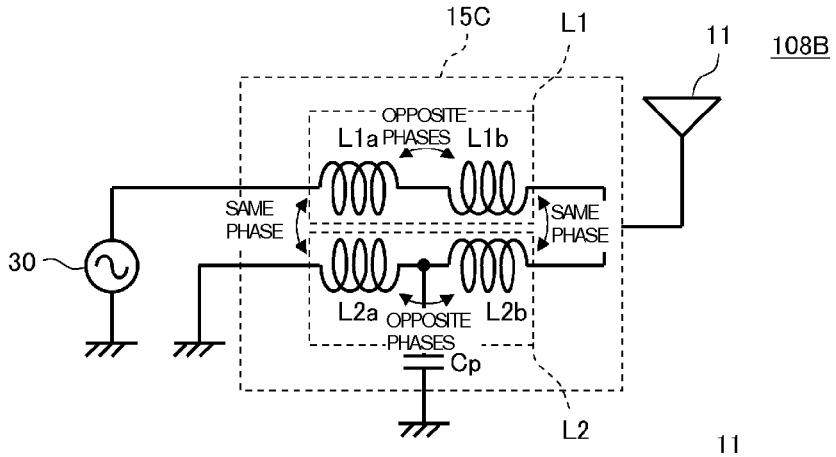
FIG. 19B is a circuit diagram of an antenna device according to a second example of an eighth preferred embodiment of the present invention.
Figure 19C:
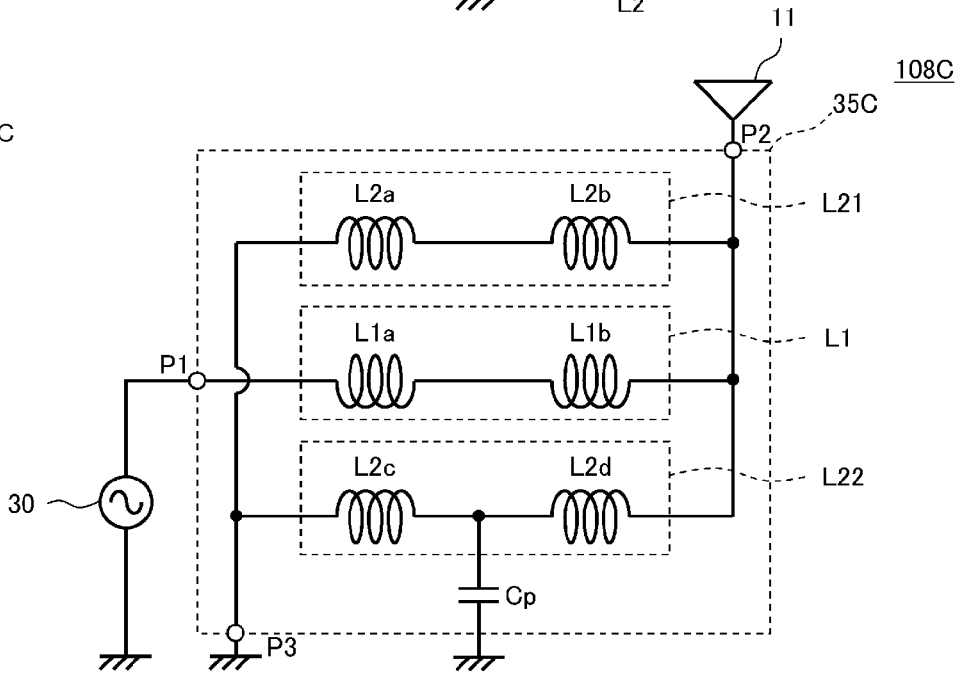
FIG. 19C is a circuit diagram of an antenna device according to a third example of an eighth preferred embodiment of the present invention.

FIG. 19A is a circuit diagram of an impedance conversion device 25C and an antenna device 108A including the same according to a first example of an eighth preferred embodiment of the present invention, FIG. 19B is a circuit diagram of an impedance conversion device 15C and an antenna device 108B including the same according to a second example of the eighth preferred embodiment, and FIG. 19C is a circuit diagram of an impedance conversion device 35C and an antenna device 108C including the same according to a third example of the eighth preferred embodiment.

The antenna device 108A illustrated in FIG. 19A includes an antenna element 11 and the impedance conversion device 25C connected to the antenna element 11. The impedance conversion device 25C is connected to a feeder terminal of the antenna element 11. The impedance conversion device 25C, and more specifically, a first inductance element L1 of the impedance conversion device 25C, is inserted between the antenna element 11 and a feeder circuit 30.

The impedance conversion device 25C includes the first inductance element L1 that is connected to the feeder circuit 30 and a second inductance element L2 that is coupled with the first inductance element L1. A first end of the first inductance element L1 is connected to the feeder circuit 30 and a second end of the first inductance element L1 is connected to the antenna element 11, and a first end of the second inductance element L2 is connected to the antenna element 11 and a second end of the second inductance element L2 is connected to ground.

In the antenna device 108A, a capacitor Cp is provided between midway along the second inductance element L2 and the ground.

The antenna device 108B illustrated in FIG. 19B includes an antenna element 11 and the impedance conversion device 15C connected to the antenna element 11. In the impedance conversion device 15C, a first inductance element L1 and a second inductance element L2 of the impedance conversion device 25C are each divided into two inductance elements and these inductance elements are arranged so that their respective mutual inductances exhibit the relationship illustrated in FIG. 19B.

The antenna device 108C illustrated in FIG. 19C includes an antenna element 11 and the impedance conversion device 35C connected to the antenna element 11. The impedance conversion device 35C includes a first inductance element L1 and two second inductance elements L21 and L22. The first inductance element L1 includes a first coil element L1*a* and a second coil element L1*b*. The second inductance element L21 includes a third coil element L2*a* and a fourth coil element L2*b*. In addition, the other second inductance element L22 includes a third coil element L2*c* and a fourth coil element Ltd.

A structure that is common to the impedance conversion devices 25C, 15C and 35C of the eighth preferred embodiment is that a capacitor Cp is preferably provided between a midway along the second inductance element and the ground. Thus, the capacitor Cp may be connected between a midway along the second inductance element and the ground.

Figure 20:
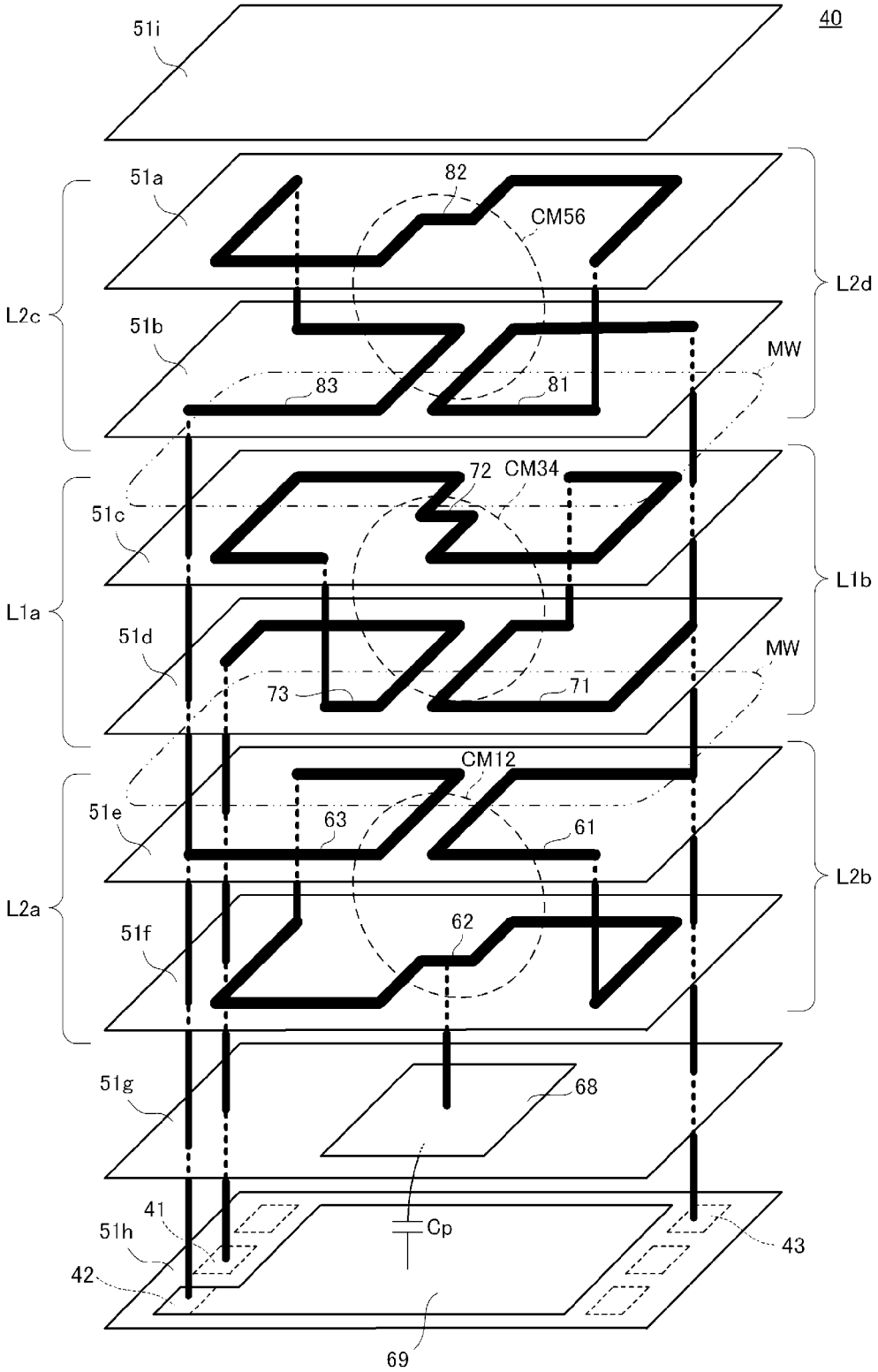
FIG. 20 illustrates an example of conductor patterns of individual layers in the case in which an impedance conversion device of an antenna device according to the eighth preferred embodiment of the present invention is provided in a multilayer substrate.

FIG. 20 illustrates an example of conductor patterns for the case in which the impedance conversion device 35C illustrated in FIG. 19C is provided in a multilayer substrate. Each layer is preferably made of a magnetic sheet and conductor patterns are provided on each of the layers.

In the region illustrated in FIG. 20, a conductor pattern 82 is provided on a substrate layer 51*a*, conductor patterns 81 and 83 are provided on a substrate layer 51*b* and a conductor pattern 72 is provided on a substrate layer 51*c*. Conductor patterns 71 and 73 are provided on a substrate layer 51*d*, conductor patterns 61 and 63 are provided on a substrate layer 51*e* and a conductor pattern 62 is provided on a substrate layer 51*f*. A conductor pattern 68 is provided on the upper surface of a substrate layer 51*g*. A ground conductor 69 is provided on the upper surface of a substrate layer 51*h*. A feeder terminal 41, a ground terminal 42, and an antenna terminal 43 are provided on a lower surface of the substrate layer 51*h*. Broken lines extending in the vertical direction in FIG. 20 represent via electrodes and the via electrodes connect the conductor patterns to each other between the layers.

In FIG. 20, the fourth coil element L2*b* is defined by the right half of the conductor pattern 62 and the conductor pattern 61. In addition, the third coil element L2*a* is defined by the left half of the conductor pattern 62 and the conductor pattern 63. In addition, the second coil element L1*b* is defined by the conductor pattern 71 and the right half of the conductor pattern 72. In addition, the first coil element L1*a* is defined by the left half of the conductor pattern 72 and the conductor pattern 73. In addition, the other fourth coil element L2*d* is defined by the conductor pattern 81 and the right half of the conductor pattern 82. In addition, the other third coil element L2*c* is defined by the left half of the conductor pattern 82 and the conductor pattern 83.

The capacitor Cp illustrated in FIG. 19C is generated between the conductor pattern 68 and the ground conductor 69. Other aspects of the structure are preferably the same or substantially the same as those of the impedance conversion device illustrated in FIG. 14.

Figure 21:
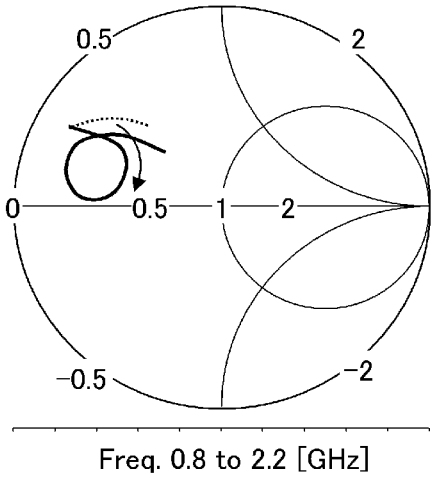
FIG. 21 illustrates an example of simulation of input impedance observed on a high-frequency circuit side from point P2 in FIG. 19C.

FIG. 21 illustrates an example of a simulation of input impedance observed on a high-frequency circuit side from point P2 illustrated in FIG. 19C. A dotted line represents the characteristics in a case in which there is no capacitor Cp. A solid line represents the characteristics in a case in which the capacitor Cp is provided. With increasing frequency in the frequency range being used, the impedance locus shifts in the direction of the arrow in the figure (clockwise). In a case in which the capacitor Cp is connected in parallel with the second inductance element, as illustrated in FIG. 3, with increasing frequency, the impedance shifts from an inductance region (top half of Smith Chart) to a capacitance region (bottom half of Smith Chart), but in the eighth preferred embodiment, due to rotation of the impedance locus in the inductance region, the degree of freedom in setting the impedance in a high-frequency region is increased and the setting of a real or imaginary portion of the impedance in a high-frequency region is simplified. Therefore, the matching of the antenna radiation resistance and impedance in a high band is simplified.

Figure 22:
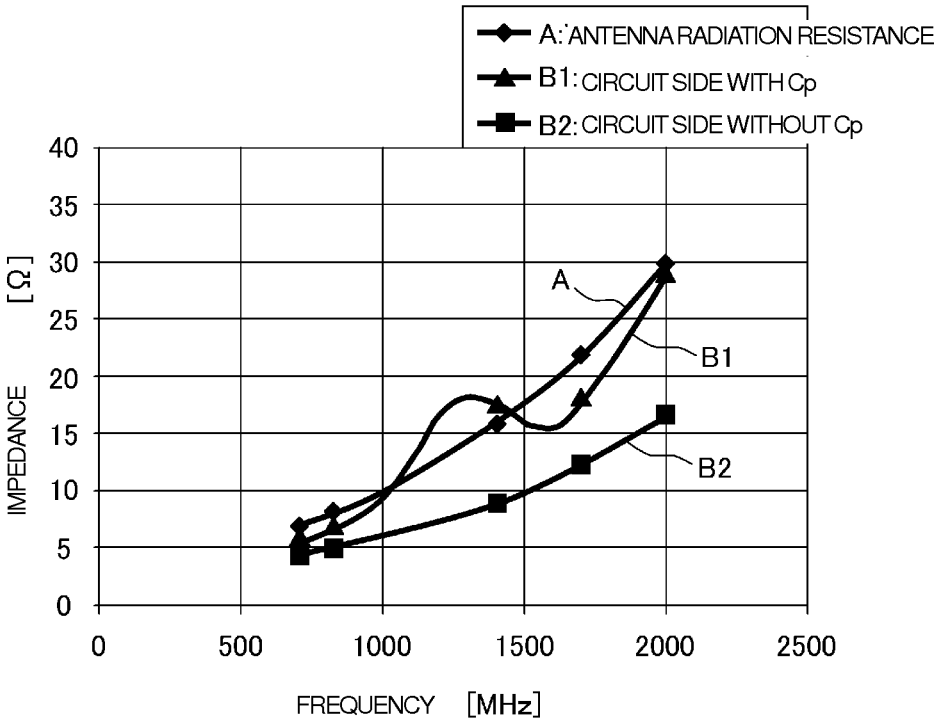
FIG. 22 illustrates the frequency characteristics of the real portion of the impedance of an impedance conversion device observed from point P2 in FIG. 19C.

FIG. 22 illustrates the frequency characteristics of the real portion of an impedance (resistance component) of the impedance conversion device 35C observed from point P2 in FIG. 19C. In FIG. 22, A denotes the antenna radiation resistance, B1 denotes the real portion of the impedance of the impedance conversion device 35C observed on the high-frequency circuit side from the point P2 in the case in which the capacitor Cp is provided, and B2 denotes the real portion of the impedance of the impedance conversion device observed on the high-frequency circuit side from the point P2 in the case in which the capacitor Cp is not provided. In the case in which the capacitance Cp is provided, compared to the example illustrated in FIG. 4, the tendency for the impedance to rise with increasing frequency is not as pronounced and in both the low band (700 MHz band) and the high band (2 GHz band) the frequency characteristics of the real portion Rc of the impedance observed on the high-frequency circuit side from the point P2 can be set to be similar to the frequency characteristics of the antenna radiation resistance Rr. That is, it is clear that matching to a high-frequency circuit can be performed over a wide frequency band.

The reason for rotation of the impedance locus in this manner is assumed to be that a resonant circuit is defined by the third coil element L2*c* and the capacitor Cp illustrated in FIG. 19C and although the impedance is increased due to the resonance of this circuit, because there is a parallel circuit including the coil elements L2*a* and L2*b*, the impedance only rises to a fixed impedance and at frequencies spaced away from the resonant frequency, a path defined by the fourth coil element L2*d* and the capacitor Cp is effective and the impedance conversion ratio is determined in accordance with the frequency.

In the example illustrated in FIG. 20, the capacitor Cp is preferably provided between a midway point along the conductor pattern 62 and the ground conductor, but the capacitor Cp may, instead, be provided midway along the conductor pattern 82 and the ground conductor.

Ninth Preferred Embodiment

In a ninth preferred embodiment of the present invention, an example of a communication terminal device including the above-described impedance conversion device 35C will be described.

Figure 23A:
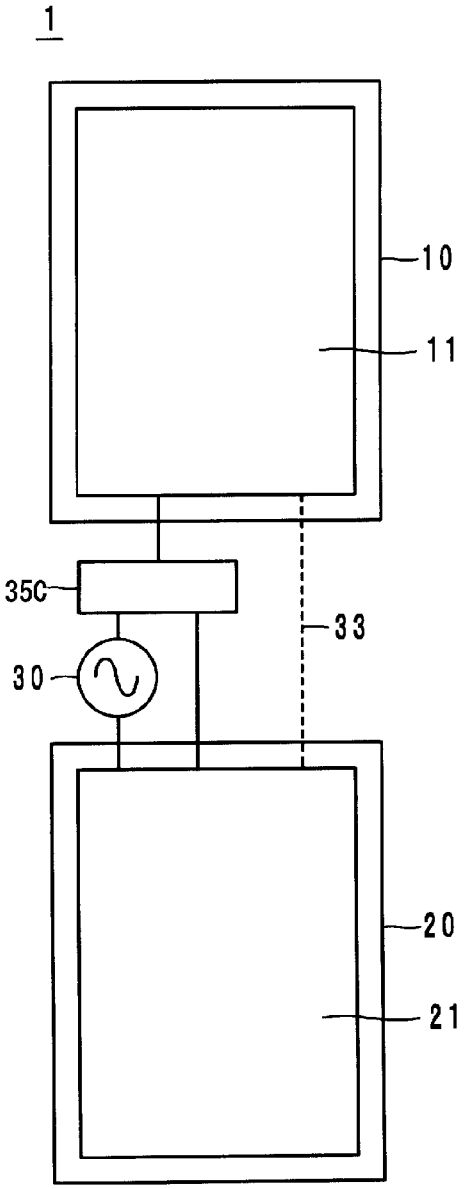
FIG. 23A is a structural diagram of a communication terminal device, which is a first example of a ninth preferred embodiment of the present invention.
Figure 23B:
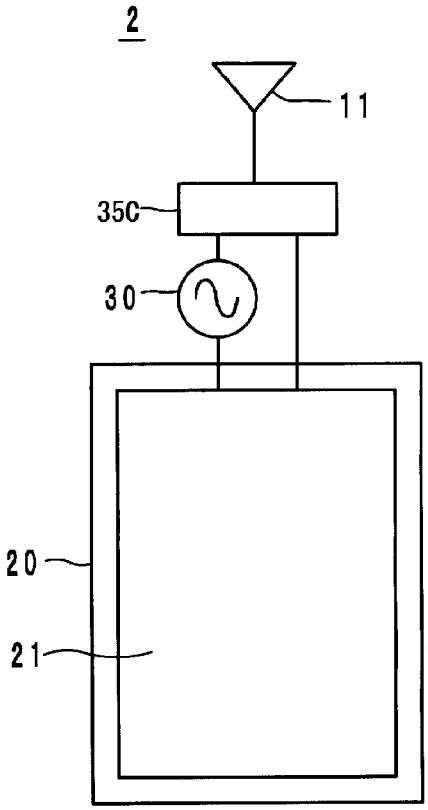
FIG. 23B is a structural diagram of a communication terminal device, which is a second example of a ninth preferred embodiment of the present invention.

FIG. 23A is a structural diagram of a communication terminal device that is a first example of the ninth preferred embodiment and FIG. 23B is a structural diagram of a communication terminal device that is a second example of the ninth preferred embodiment. These terminal devices are terminals to receive high-frequency signals of a one segment component reception service (commonly referred to as One Seg) for, for example, cellular phones and mobile terminals.

A communication terminal device 1 illustrated in FIG. 23A includes a first casing 10, which is a lid, and a second casing 20, which is a main body, and the first casing is preferably connected to the second casing 20 in a folding or sliding manner. A first radiating element 11, which functions as a ground plate, is provided in the first casing 10 and a second radiating element 21, which functions as a ground plate, is provided in the second casing 20. The first and second radiating elements 11 and 21 are preferably made of a conductor film composed of a thin film, such as a metal foil, or a thick film, such as one composed of a conductive paste, for example. With the first and second radiating elements 11 and 21, substantially the same performance is obtained as with a dipole antenna by performing differential feeding from the feeder circuit 30. The feeder circuit 30 includes a signal processing circuit, such as an RF circuit or a base band circuit, for example.

The inductance value of the impedance conversion device 35C is preferably less than the inductance value of a connection line 33 that connects the two radiating elements 11 and 21, such that the effect of the inductance value of the connection line 33 on the frequency characteristics is small. In a communication terminal device 2 illustrated in FIG. 23B, a first radiating element 11 is preferably provided as an antenna body. Any of various antenna elements can be used as the first radiating element 11, such as a chip antenna, a sheet metal antenna or a coil antenna, for example. In addition, as the antenna element, for example, a line-shaped conductor provided along an inner peripheral surface or an outer peripheral surface of the casing 10 may preferably be used. The second radiating element 21 functions as a ground plate of the second casing 20 and, similarly to the first radiating element 11, any of various antennas may be used as the second radiating element 21. The communication terminal device 2 is preferably a terminal having a straight structure rather than a folding or sliding structure. The second radiating element 21 need not necessarily function as a radiating body and the first radiating element 11 may behave as a monopole antenna.

One terminal of the feeder circuit 30 is connected to the second radiating element 21 and the other terminal of the feeder circuit 30 is connected to the first radiating element 11 via the impedance conversion device 35C. In addition, the first and second radiating elements 11 and 21 are connected to each other by the connection line 33. The connection line 33 functions as a connection line of electronic components (not illustrated) mounted in the first and second casings 10 and 20 and as an inductance element for a high-frequency signal, but does not directly affect antenna performance.

The impedance conversion device 35C is provided between the feeder circuit 30 and the first radiating element 11 and stabilizes the frequency characteristics of a high-frequency signal to be transmitted from the first and second radiating elements 11 and 21 or stabilizes the frequency characteristics of a high-frequency signal received via the first and second radiating elements 11 and 21. Accordingly, there is no influence resulting from the shapes of the first radiating element 11 and the second radiating element 21, the shapes of the first casing 10 and the second casing 20, and the arrangement of nearby components, and the frequency characteristics of a high-frequency signal are stabilized. In particular, for folding and sliding type communication terminal devices, the impedances of the first and second radiating elements 11 and 21 easily change depending on whether the first casing 10, which is the lid, is open or closed with respect to the second casing 20, which is the main body, but the frequency characteristics of a high-frequency signal can be stabilized by providing the impedance conversion device 35C. That is, the impedance conversion device 35C provides the function of adjusting frequency characteristics, such as setting a center frequency, setting a pass band width, and setting impedance matching, which are important tasks in antenna design, and since primarily directivity and gain of the antenna element need to be considered, antenna design is simplified.

Other Preferred Embodiments

In some of the above-described preferred embodiments, an example in which both the first inductance element and the second inductance element are preferably defined by a single coil element and an example in which both the first inductance element and the second inductance element are preferably defined by two coil elements were described. However, alternatively, one of the first inductance element and the second inductance element may be defined by a single coil element and the other may be defined by two coil elements.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An impedance conversion device arranged to be inserted between an antenna element and a feeder circuit, the impedance conversion device comprising:

a first circuit including a first inductance element connected to the feeder circuit; and a second circuit including a second inductance element connected to the antenna element and coupled with the first inductance element; wherein the second circuit includes a capacitor connected to the second inductance element;

the capacitor is connected in parallel with the second inductance element; and a first end of the first circuit is connected to the feeder circuit, a second end of the first circuit is connected to the antenna element, a first end of the second circuit is connected to the antenna element and a second end of the second circuit is connected to ground.

2. The impedance conversion device according to claim 1, wherein the first inductance element and the second inductance element are defined by conductor patterns arranged inside a multilayer body that includes a plurality of dielectric layers or magnetic layers that are stacked on one another and the capacitor is a chip capacitor mounted on the multilayer body.

3. The impedance conversion device according to claim 1, wherein the first inductance element and the second inductance element are defined by conductor patterns arranged inside a multilayer body that includes a plurality of dielectric layers or magnetic layers that are stacked on one another and the capacitor is defined by electrodes that are provided inside the multilayer body and that oppose each other.

4. The impedance conversion device according to claim 1, wherein an effective inductance component of the antenna element is reduced by an equivalent negative inductance generated due to the first inductance element and the second inductance element being closely coupled with each other.

5. The impedance conversion device according to claim 1, wherein the first inductance element includes a first coil element and a second coil element and the first coil element and the second coil element are connected in series with each other and include conductor coil patterns that define a closed magnetic circuit.

6. The impedance conversion device according to claim 5, wherein the second inductance element includes a third coil element and a fourth coil element and the third coil element and the fourth coil element are connected in series with each other and include conductor coil patterns that define a closed magnetic circuit.

7. The impedance conversion device according to claim 6, wherein the capacitor is connected between a connection point between the third coil element and the fourth coil element, and ground.

8. The impedance conversion device according to claim 6, wherein conductor patterns of the first coil element and the second coil element have a line width that is less than or equal to a line width of conductor patterns of the third coil element and the fourth coil element, and conductor patterns of the third coil element and the fourth coil element are respectively superposed with the conductor patterns of the first coil element and the second coil element when viewed in plan.

9. The impedance conversion device according to claim 1, wherein the first inductance element and the second inductance element are coupled with each other through a magnetic field and an electric field and, when an alternating current flows through the first inductance element, a direction in which a current flows through the second inductance element due to coupling via the magnetic field and a direction in which a current flows through the second inductance element due to coupling via the electric field are the same direction.

10. The impedance conversion device according to claim 1, wherein, when an alternating current flows through the first inductance element, a direction in which a current flows through the second inductance element is such that a magnetic wall is generated between the first inductance element and the second inductance element.

11. The impedance conversion device according to claim 1, wherein the first inductance element and the second inductance element are defined by conductor patterns arranged inside a multilayer body including a plurality of dielectric layers or magnetic layers that are stacked on one another, and the first inductance element and the second inductance element are coupled with each other inside the multilayer body.

12. The impedance conversion device according to claim 11, wherein the second inductance element includes at least two inductance elements that are electrically connected in parallel with each other, and the at least two inductance elements are arranged such that the first inductance element is interposed therebetween.

13. The impedance conversion device according to claim 11, wherein a ground conductor is provided inside the multilayer body and the second inductance element is arranged so as to be closer to the ground conductor than the first inductance element, and the capacitor is defined by a stray capacitance generated between the second inductance element and the ground conductor.

14. The impedance conversion device according to claim 13, wherein the ground conductor is arranged so as to sandwich the at least two inductance elements from the outside.

15. An impedance conversion device arranged to be inserted between an antenna element and a feeder circuit, the impedance conversion device comprising:

a first circuit including a first inductance element connected to the feeder circuit; and a second circuit including a second inductance element coupled with the first inductance element; wherein frequency characteristics of a real portion of an impedance of the second circuit are different from frequency characteristics of the first circuit in a direction in which frequency characteristics of a real portion of an impedance of the impedance conversion circuit observed from the antenna element side approach frequency characteristics of a radiation resistance of the antenna element;

the second circuit includes a capacitor that is connected to the second inductance element;

the capacitor is connected in parallel with the second inductance element; and a first end of the first circuit is connected to the feeder circuit, a second end of the first circuit is connected to the antenna element, a first end of the second circuit is connected to the antenna element and a second end of the second circuit is connected to ground.

16. An antenna device comprising:

an antenna element; and an impedance conversion circuit inserted between the antenna element and a feeder circuit; wherein the impedance conversion circuit includes:

a first circuit including a first inductance element connected to the feeder circuit; and a second circuit connected between the antenna element and ground and including a second inductance element that is coupled with the first inductance element;

the second circuit includes a capacitor that is connected to the second inductance element;

the capacitor is connected in parallel with the second inductance element; and a first end of the first circuit is connected to the feeder circuit, a second end of the first circuit is connected to the antenna element, a first end of the second circuit is connected to the antenna element and a second end of the second circuit is connected to ground.

17. A communication terminal device comprising:

an antenna device that includes an antenna element, a feeder circuit, and an impedance conversion circuit connected between the antenna element and the feeder circuit; wherein the impedance conversion circuit includes:

a first circuit including a first inductance element connected to the feeder circuit; and a second circuit that is connected between the antenna element and ground and including a second inductance element that is coupled with the first inductance element;

the second circuit includes a capacitor that is connected to the second inductance element;

the capacitor is connected in parallel with the second inductance element; and a first end of the first circuit is connected to the feeder circuit, a second end of the first circuit is connected to the antenna element, a first end of the second circuit is connected to the antenna element and a second end of the second circuit is connected to ground.

* * * * *